US011228145B2

(12) United States Patent
Maesoba et al.

(10) Patent No.: US 11,228,145 B2
(45) Date of Patent: Jan. 18, 2022

(54) COMMUNICATION CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 15/503,740

(22) PCT Filed: Sep. 3, 2015

(86) PCT No.: PCT/JP2015/075030
§ 371 (c)(1),
(2) Date: Feb. 14, 2017

(87) PCT Pub. No.: WO2016/035841
PCT Pub. Date: Mar. 10, 2016

(65) Prior Publication Data

US 2017/0256892 A1 Sep. 7, 2017

(30) Foreign Application Priority Data

Sep. 4, 2014 (JP) ..... JP2014-180347
Jan. 28, 2015 (JP) ..... JP2015-014379
Mar. 11, 2015 (JP) ..... JP2015-048636

(51) Int. Cl.
*H01R 13/6589* (2011.01)
*H01R 24/22* (2011.01)
*H01R 107/00* (2006.01)

(52) U.S. Cl.
CPC ..... *H01R 13/6589* (2013.01); *H01R 24/22* (2013.01); *H01R 2107/00* (2013.01)

(58) Field of Classification Search
CPC .. H01R 9/0506; H01R 12/596; H01R 12/775; H01R 13/6589
(Continued)

(56) References Cited

U.S. PATENT DOCUMENTS 4,615,578 A * 10/1986 Stadler ..... H01R 12/775 439/607.47
6,210,230 B1 * 4/2001 Lai ..... H01R 9/0518 439/101
(Continued)

FOREIGN PATENT DOCUMENTS

JP 2004-79377 3/2004
JP 2004-342563 12/2004
(Continued)

OTHER PUBLICATIONS

International Search Report dated Nov. 10, 2015.

*Primary Examiner* — Tulsidas C Patel
*Assistant Examiner* — Marcus E Harcum
(74) *Attorney, Agent, or Firm* — Gerald E. Hespos; Michael J. Porco; Matthew T. Hespos

(57) ABSTRACT

A communication connector (10) includes a plurality of wires (11A to 11C, 12A, 12B, 13, 14) for transmitting communication signals, a plurality of terminals (20) connected to the respective wires (11A to 11C, 12A, 12B, 13, 14), a housing (30) for accommodating the respective terminals (20), and a conductive shield wall portion (40) arranged between the plurality of wires (11A to 11C, 12A, 12B, 13, 14).

10 Claims, 60 Drawing Sheets

(58) Field of Classification Search
USPC ..... 439/497, 579, 607.41, 607.47, 607.45
See application file for complete search history.

(56) References Cited

U.S. PATENT DOCUMENTS

| | | | | |
|---|---|---|---|---|
| 6,290,542 | B1 * | 9/2001 | Kuo | H01R 12/592 439/607.49 |
| 6,380,485 | B1 * | 4/2002 | Beaman | H01R 9/035 174/88 R |
| 6,489,563 | B1 * | 12/2002 | Zhao | H01R 9/0524 174/88 C |
| 6,551,129 | B2 * | 4/2003 | Kato | H01R 4/66 439/395 |
| 6,685,501 | B1 * | 2/2004 | Wu | H01R 13/6471 439/493 |
| 6,752,633 | B2 * | 6/2004 | Aizawa | H01R 9/034 439/579 |
| 6,991,493 | B2 * | 1/2006 | Matsui | H01R 4/64 439/579 |
| 7,503,776 | B1 * | 3/2009 | Pavlovic | H01R 4/46 439/455 |
| 7,651,379 | B1 * | 1/2010 | Wu | H01R 12/62 439/108 |
| 7,670,154 | B2 * | 3/2010 | Yu | H01R 4/184 439/579 |
| 7,744,402 | B2 * | 6/2010 | Wu | H01R 12/592 439/455 |
| 7,896,689 | B1 * | 3/2011 | Su | H01R 9/032 439/497 |
| 8,011,950 | B2 * | 9/2011 | McGrath | H01R 12/594 439/497 |
| 8,167,653 | B2 * | 5/2012 | Hasegawa | H01R 13/6593 439/607.41 |
| 9,190,769 | B2 * | 11/2015 | Nonen | H01R 13/5829 |
| 9,466,925 | B2 * | 10/2016 | Rost | H01R 9/032 |
| 2004/0235360 | A1 | 11/2004 | Takahashi | |
| 2006/0014431 | A1 | 1/2006 | Shuey et al. | |
| 2007/0066142 | A1 * | 3/2007 | Shindo | H01R 13/648 439/497 |
| 2011/0244733 | A1 * | 10/2011 | Ueda | H01R 9/032 439/660 |
| 2011/0300750 | A1 * | 12/2011 | Nagawatari | H01R 9/035 439/607.01 |

FOREIGN PATENT DOCUMENTS

| | | |
|---|---|---|
| JP | 2008-507110 | 3/2008 |
| JP | 2012-18898 | 1/2012 |

* cited by examiner

COMMUNICATION CONNECTOR

BACKGROUND

1. Field of the Invention

The present invention relates to a communication connector.

2. Description of the Related Art

Communication connectors are known. An electrical connector capable of receiving four USB plug connectors is described in Japanese Unexamined Patent Application Publication No. 2008-507110. This electrical connector includes a housing, electrical contacts made of metal and bent into an L shape, an outer shield and an inner shield. The electrical contacts are fixed side by side in a lateral direction to each USB plug connector.

The L-shaped electrical contacts as conductors are not shielded from each other. Thus, wires used as conductors in high-speed communication may be affected by noise.

The present invention was completed based on the above situation and aims to suppress the influence of noise on wires.

SUMMARY

The invention is directed to a communication connector with wires for transmitting communication signals and terminals connected to the respective wires. A housing is provided for accommodating the terminals, and a conductive shield is arranged between the wires.

According to this configuration, the conductive shield wall between the wires suppresses the influence of noise on the wires.

In one embodiment, the wires include a USB 3.0 first wire and a USB 2.0 second wire, and the shield is arranged between the first wire and the second wire.

In another embodiment, the wires include a USB 3.0 first wire and a power supply wire connected to a power supply, and the shield is arranged between the first wire and the power supply wire.

In a further embodiment, the wires include a plurality of USB 3.0 first wires, and the shield is arranged between the first wires.

Wire rows formed by arranging the wires in parallel, and the shield is arranged between the wire rows.

The shield may include a first wall arranged between the wire rows and second walls standing on the first wall and arranged between the wires in each wire row.

A conductive coupling wall may be provided and may couple the second walls to cover the wires between adjacent second walls.

In one embodiment, plural USB 3.0 first wires are provided in each wire row, and the first wires partitioned by the second wall in one wire row are arranged at positions diagonal to the first wires in a different wire row.

The shield may be formed by connecting a plurality of partition plates, and the second wall may stand on the first wall in each partition plate.

The shield may be fixed by being press-fit into the housing.

The shield may be made of conductive resin.

A shield case may cover the housing, and the shield may includes a case connecting portion to be connected electrically connected to the shield case.

In another embodiment, a shield case covers the housing, and the shield wall is formed integrally formed to the shield case.

The housing may include a supporting portion for supporting the shield.

The housing may include cavities for accommodating the respective terminals, and the communication connector may be installed in a vehicle.

According to the present invention, it is possible to suppress the influence of noise on wires.

SUMMARY

A first embodiment is described with reference to FIGS. 1 to 13. A communication connector 10 is installed in a vehicle such as an electric vehicle or hybrid vehicle and arranged in a wired communication path between an in-vehicle electric component (navigation system, ETC system, monitor, etc.) in the vehicle and an external device (camera, etc.) or between in-vehicle electric components. In the following description, a vertical direction (Y-axis) and a lateral direction (X-axis) are based on directions of FIG. 2, and a left side and a right side of FIG. 4 are referred to as a front side and a rear side concerning a front-rear direction (Z-axis).

Figure 3:
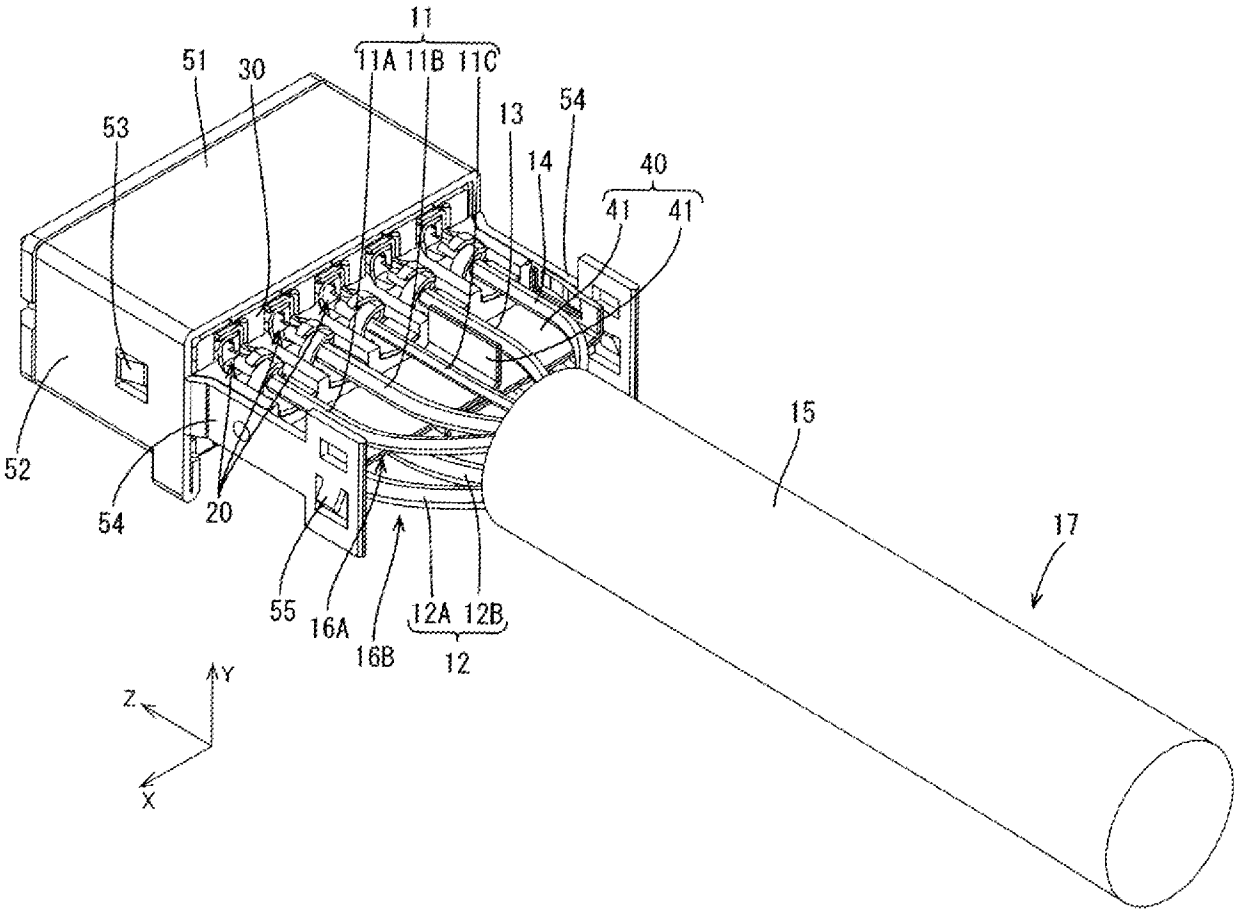
FIG. 3 is a perspective view showing the communication connector in a state where a second shield case is removed.
Figure 4:
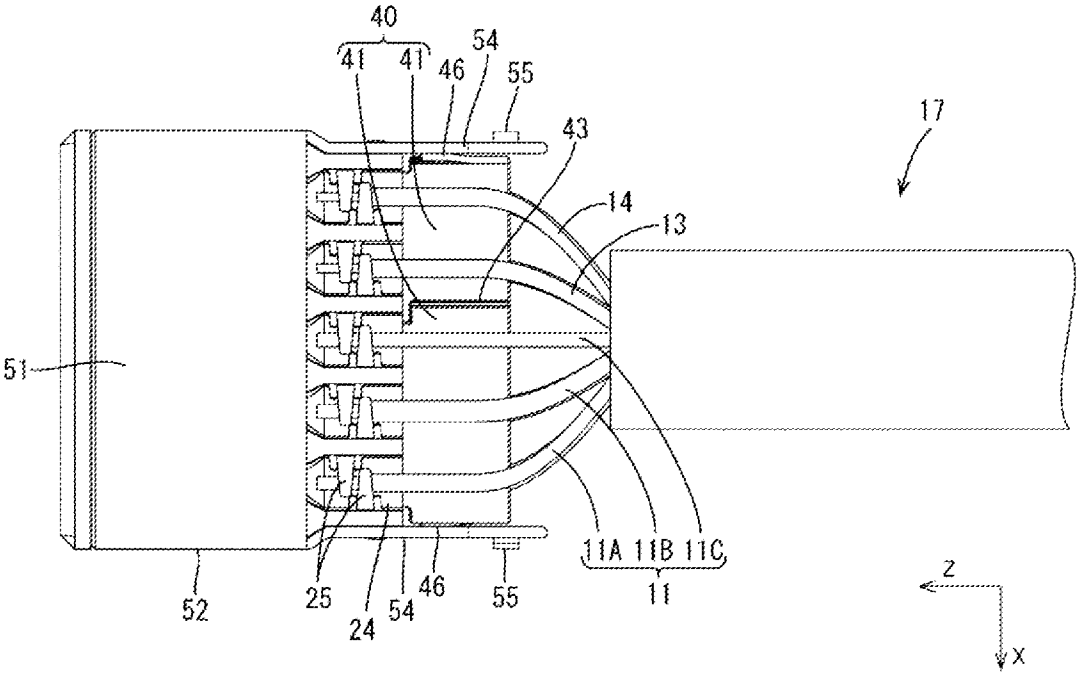
FIG. 4 is a plan view showing the communication connector in the state where the second shield case is removed.

The communication connector 10 of this embodiment includes, as shown in FIG. 3, a shielded cable 17 having a plurality of (ten in this embodiment) wires 11,12, 13 and 14. The wires 11 are composed of two sets of first wires 11A to 11C, and the wires 12 are composed of one set of second wires 12, 12B. Terminals 20 are connected to end parts of the respective wires 11 to 14. A housing 30 accommodates the terminals 20, and a conductive shield 40 provides shielding between the wires 11 to 14 extending rearward of the housing 30. A shield case 50 (see FIG. 1) is provided for covering the housing 30 and the wires 11 to 14.

(Shielded Cable 17)

The shielded cable 17 is capable of communication of USB (Universal Serial Bus) 3.0 standard and includes ten wires 11 to 14. A shield layer (not shown) collectively encloses the ten wires 11 to 14 and is formed of a braided wire formed by braiding thin metal wires. An insulation coating 15 covers the outer periphery of the shield layer an is made of insulating synthetic resin.

(Wires 11 to 14)

The ten wires 11 to 14 include two sets of USB 3.0 wires 11 (differential pair cable with a shield and a drain wire), one set of USB 2.0 wires 12 (twisted pair cable without a shield), a power supply wire 13 connected to a power supply and a ground wire 14 connected to ground.

Each wire 11 to 14 is formed by covering a conductor formed of a metal wire with an insulation coating made of insulating synthetic resin. End parts of the ten wires 11 to 14 extending forward from ends of the shield layer and the insulation coating 15 of the shielded cable 17 have the insulation layers removed to expose conductors to be connected to the terminals 20. Five of the wires 11 to 14 are arranged side by side in a row in each of two separate upper and lower stages to extend toward a tip side, thereby constituting upper and lower wire rows 16A, 16B.

(Terminals 20)

Figure 5:
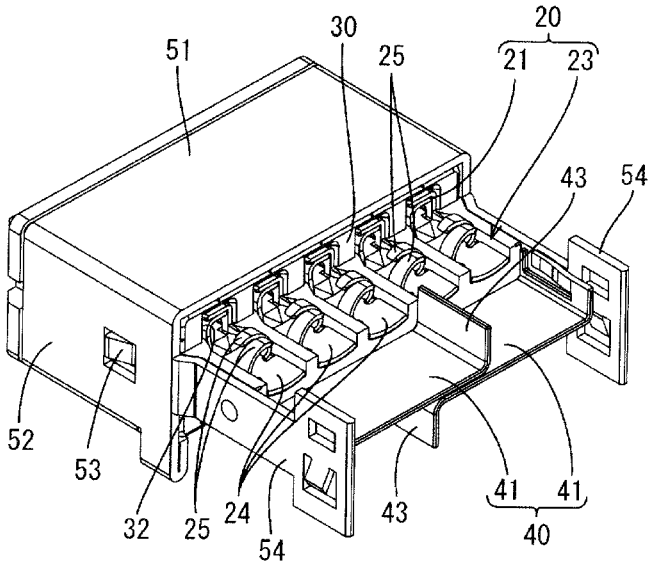
FIG. 5 is a perspective view showing the communication connector in a state where the second shield case and the shielded cable are removed.
Figure 6:
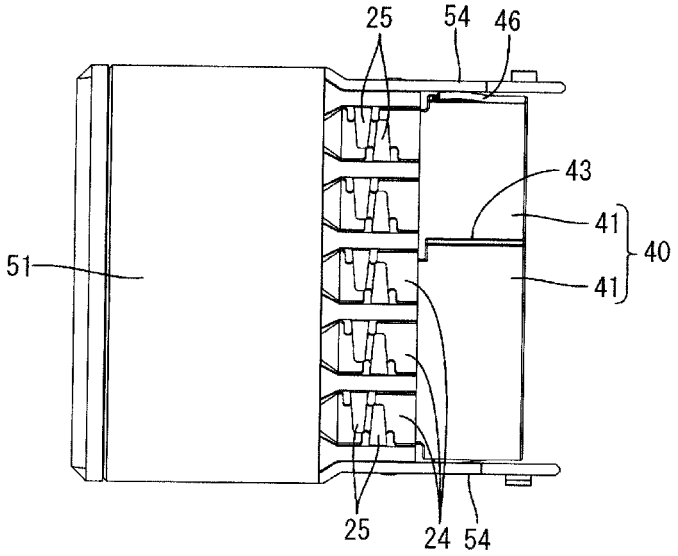
FIG. 6 is a plan view showing the communication connector in the state where the second shield case and the shielded cable are removed.
Figure 7:
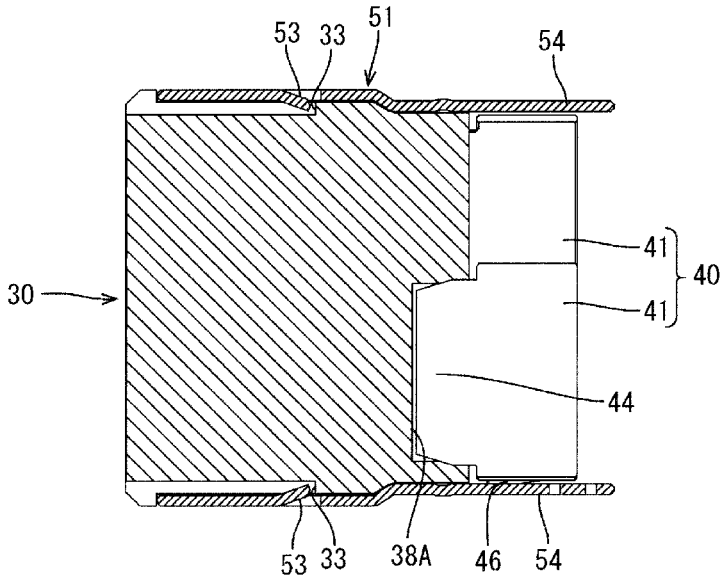
FIG. 7 is a plan view in section at a height of press-fit holes in the state of FIG. 6.
Figure 14:
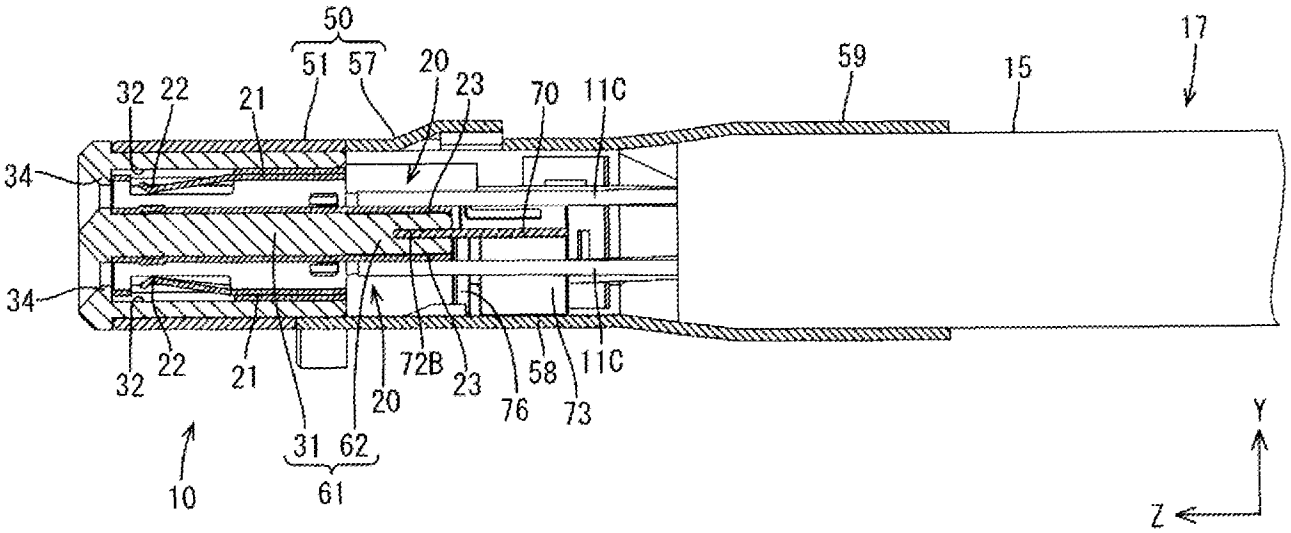
FIG. 14 is a longitudinal section showing a communication connector of a second embodiment connected to an end part of a shielded cable.
Figure 15:
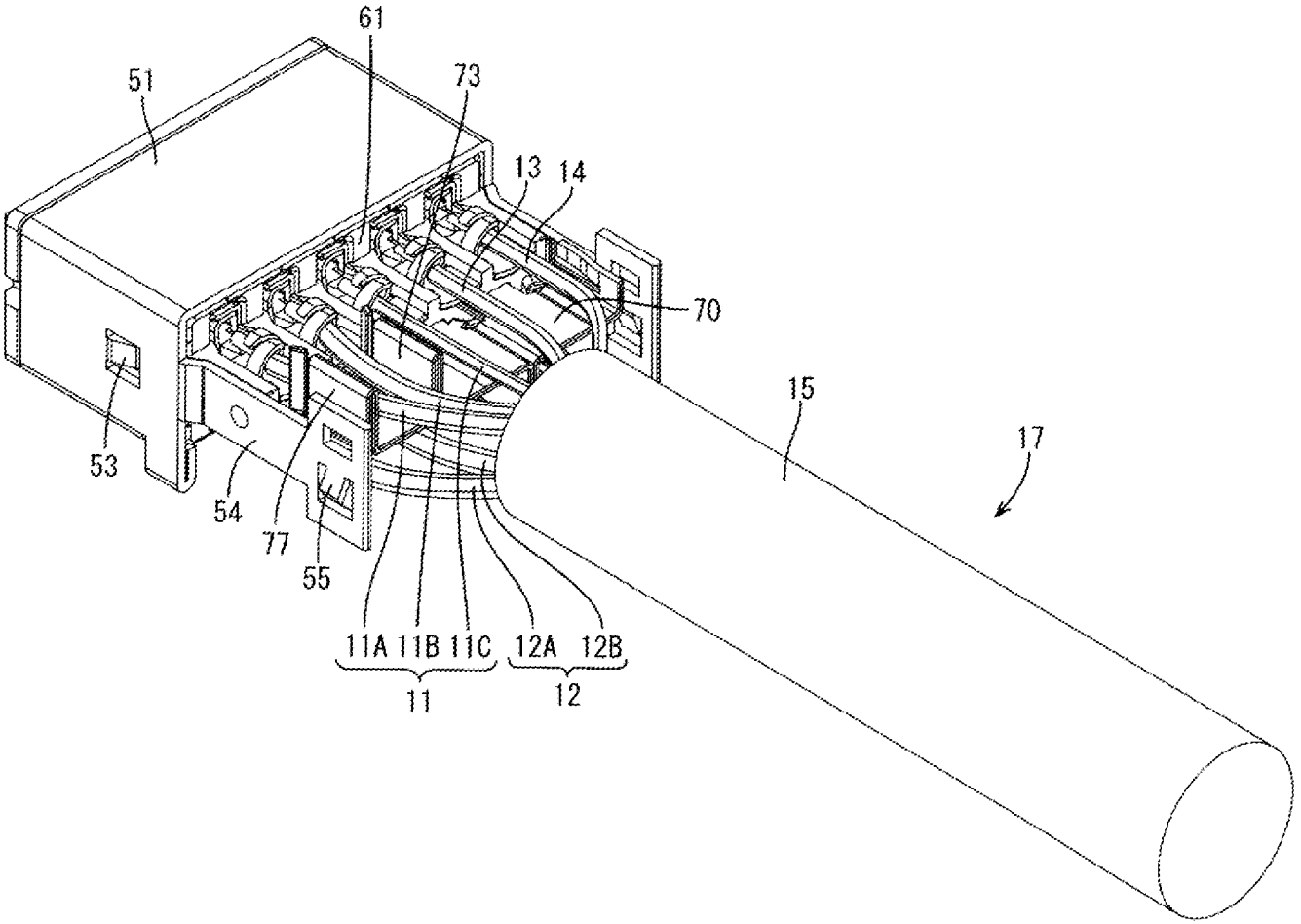
FIG. 15 is a perspective view showing the communication connector connected to the end part of the shielded cable in a state where a second shield case is removed.
Figure 16:
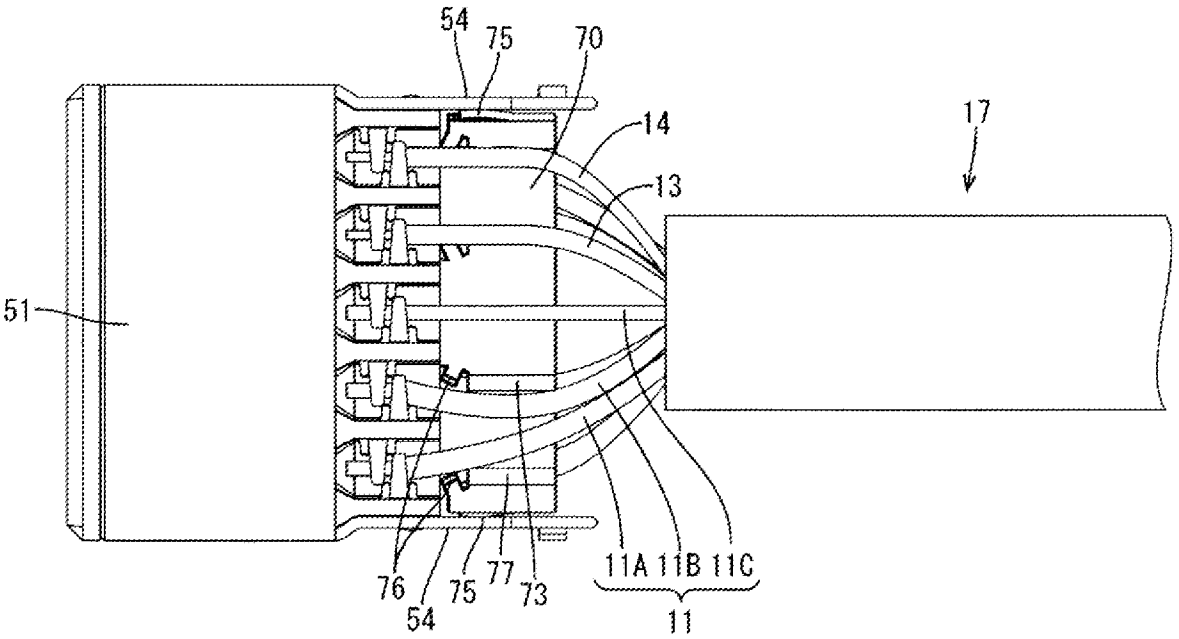
FIG. 16 is a plan view showing the communication connector connected to the end part of the shielded cable in the state where the second shield case is removed.
Figure 17:
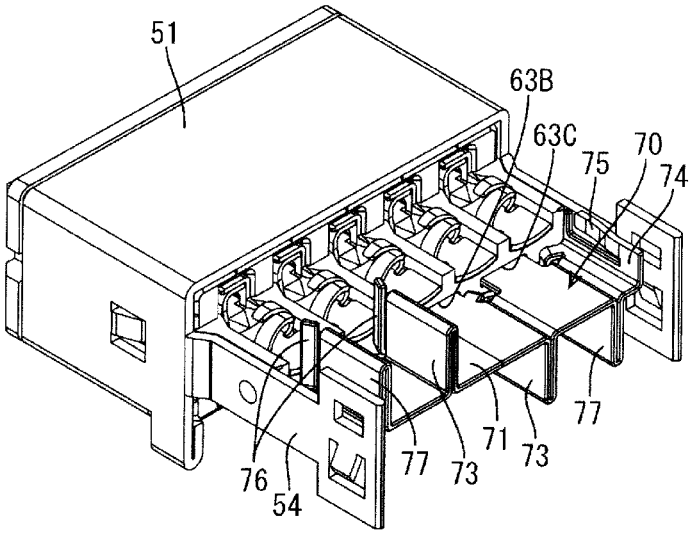
FIG. 17 is a perspective view showing the communication connector in a state where the second shield case and the shielded cable are removed.
Figure 18:
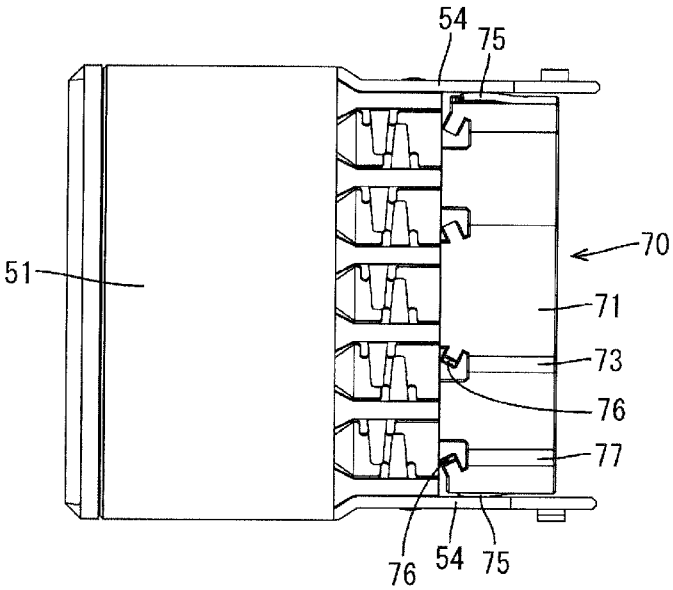
FIG. 18 is a plan view showing the communication connector in the state where the second shield case and the shielded cable are removed.
Figure 19:
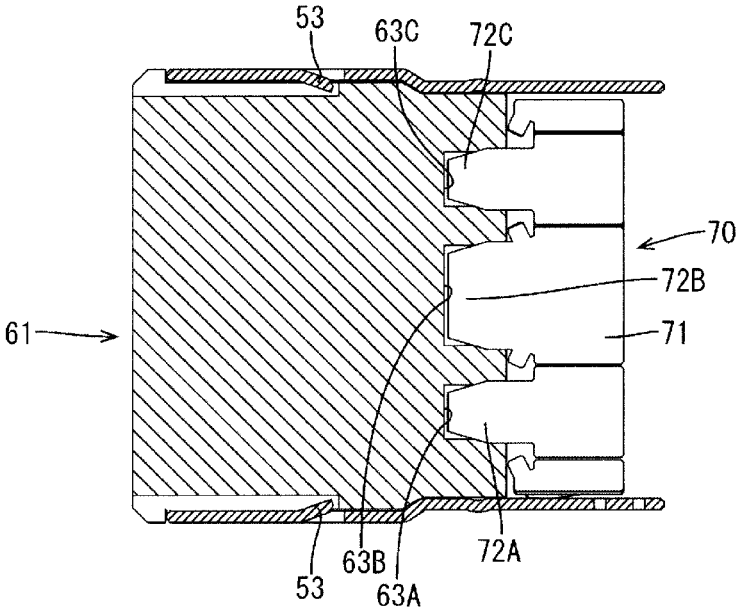
FIG. 19 is a plan view in section at a height of press-fit holes in the state of FIG. 18.

As shown in FIG. 5, a front side of the terminal 20 serves as a terminal connecting portion 21 in the form of a rectangular tube, and a wire connecting portion 23 to be connected to the conductor of the wire 11 to 14 is formed integrally behind the terminal connecting portion 21. A resilient contact piece 22 (see FIG. 14) to be connected to a mating male terminal is provided in the terminal connecting portion 21. The wire connecting portion 23 includes a bottom plate 24 and two barrel pieces 25 extending from side edges of the bottom plate 24. The conductor of the wire 11 to 14 is connected electrically to the wire connecting portion 23, for example, by being soldered or welded to the bottom plate 24.

(Housing 30)

Figure 8:
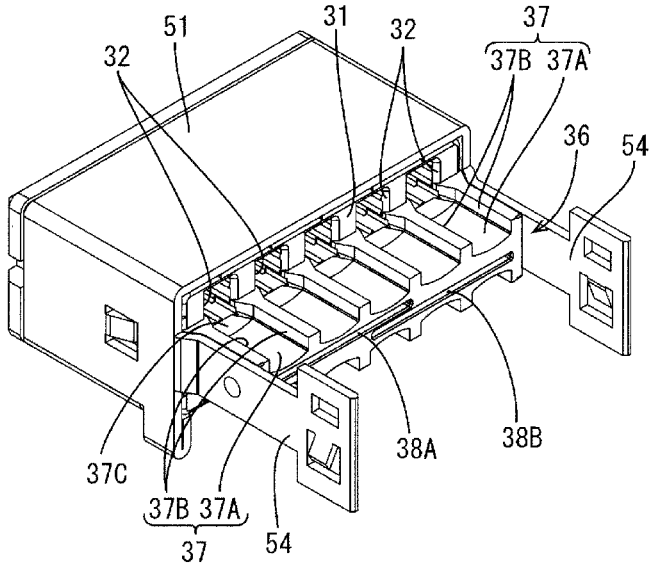
FIG. 8 is a perspective view showing a state where a first shield case is mounted in a housing.
Figure 9:
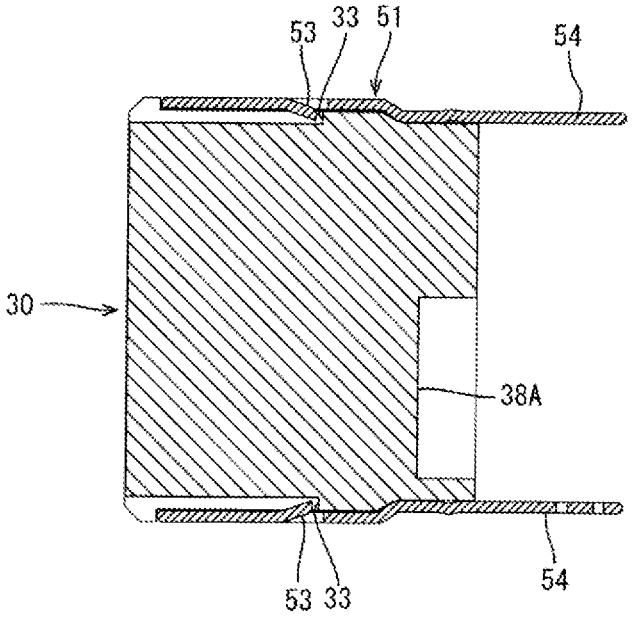
FIG. 9 is a plan view in section at the height of the press-fit holes in the state of FIG. 8.

As shown in FIG. 8, the housing 30 includes a body 31 made of insulating synthetic resin and is configured to accommodate the terminal connecting portions 21 of the respective terminals 20, and an extending portion 36 extends behind the body 31 and has a small thickness. The body 31 has a rectangular parallelepiped shape and five cavities 32 for accommodating the terminals 20 are arranged at intervals in the lateral direction in each of two upper and lower stages.

Each cavity 32 has a rectangular cross-section in conformity with the outer peripheral shape of the terminal connecting portion 21 and extends in the front-rear direction according to a length of the terminal connecting portion 21. A front stop wall 34 is formed in a front end part of the cavity 32 (see FIG. 14) for restricting a forward movement of the terminal 20. The front stop wall 34 is formed by narrowing a hole diameter of the cavity 32 in a stepped manner. A resiliently deformable detachment restricting piece for restricting the detachment of the terminal 20 toward a rear side by locking the terminal connecting portion 21 extends in a cantilever manner on an inner wall of the cavity 32

The extending portion 36 is in the form of a plate extending rearward from a vertically middle part of the rear end of the body 31 and includes, as shown in FIG. 8, a plurality of groove-like placing portions 37 arranged such that the wire connecting portions 23 of the respective terminals 20 can be placed thereon, and press-fit holes 38A, 38B open on the rear end surface of the extending portion 36. The placing portion 37 includes a bottom surface 37A and groove walls 37B standing from both side edges of the bottom surface 37A. The placing portions 37 are formed side by side in the lateral direction according to the number of the terminals 20 on each of the upper and bottom surfaces of the extending portion 36. The bottom surface 37A has an inclined surface 37C slightly curved to be lower at a middle side and inclined such that a tip side becomes lower toward a front side. The groove walls 37B are inclined to narrow the bottom surface 37A toward the front side and are connected to the cavity 32.

The press-fit holes 38A, 38B are formed by recessing the rear end surface of the extending portion 36 to have such a depth that press-fit portions 44 are press-fitted. Left and right press-fit holes 38A, 38B are provided to have slightly different heights and arranged to vertically overlap at the middle side.

(Shield Wall Portion 40)

Figure 10:
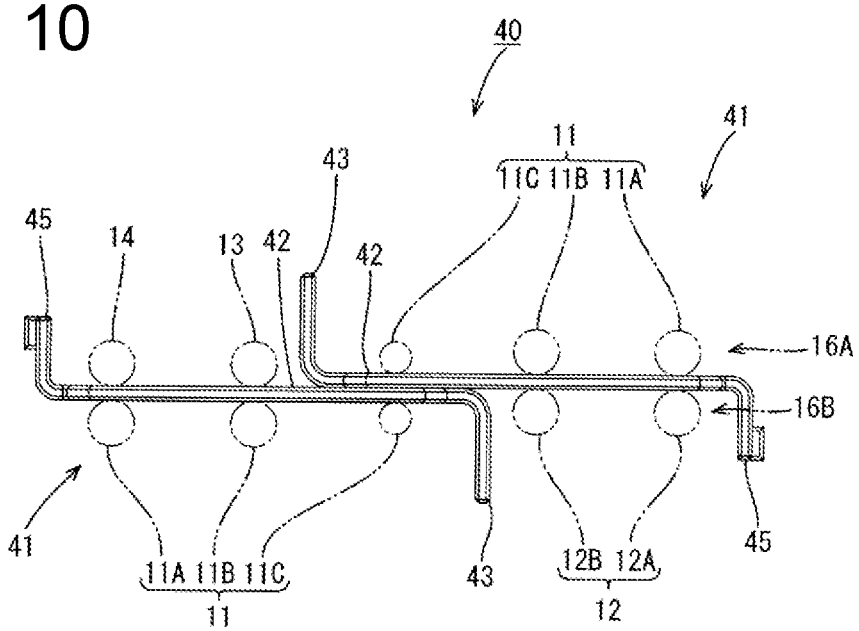
FIG. 10 is a front view showing a shield wall portion.
Figure 11:
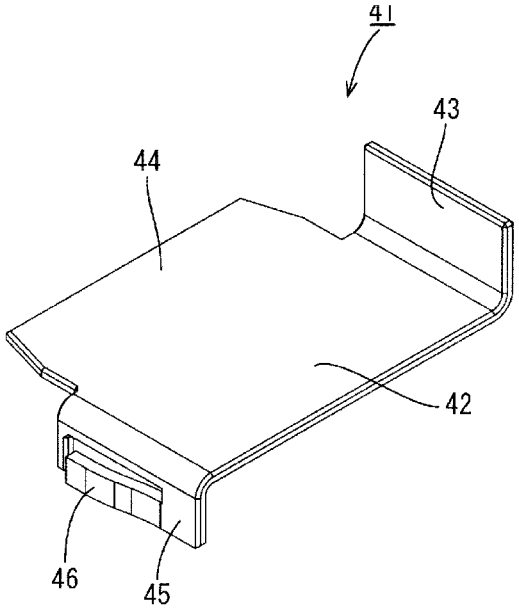
FIG. 11 is a perspective view showing the partition plate.
Figure 12:
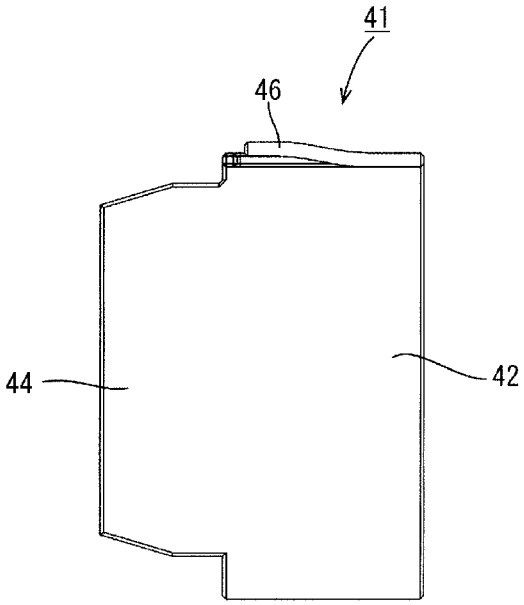
FIG. 12 is a plan view showing the partition plate.
Figure 13:
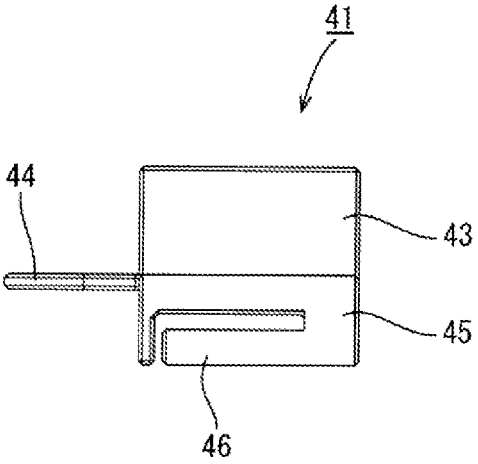
FIG. 13 is a side view showing the partition plate.

As shown in FIGS. 10 and 11, the shield 40 is configured by connecting two partition plates 41, 41. The two partition plates 41, 41 are identically shaped, formed by applying punching and bending to a metal plate material such as aluminum, aluminum alloy, copper or copper alloy. Each partition plate 41, 41 includes a rectangular plate-like first wall 42 extending in the lateral direction, a second wall 43 standing from one side edge of the first wall 42, a case connecting portion 45 standing toward a side opposite to the second wall 43 from the other side edge of the first wall 42 and the press-fitting portion 44 in front of and continuous and flush with the first wall 42 and to be press-fit into the press-fit hole 38A, 38B.

The second wall 43 has a rectangular shape and is formed over the entire length of the side edge of the first wall 42. A height of the second wall 43 is set such that the second wall portion 43 is in contact with an inner wall of a second shield case 57. The case connecting portion 45 includes a resilient piece 46 configured to resiliently contact the inner wall of the second shield case 57. The resilient piece 46 is cantilevered forward with a rear end side as a base end. The press-fitting portion 44 is formed over substantially the entire width of the first wall 42 and narrowed toward a tip side by having both side edge parts of the tip side obliquely cut.

The two partition plates 41, 41 are connected laterally at a predetermined position with the front and back sides of one partition plate 41 set opposite to those of the other, and the second walls 43 located at an inner side and the case connecting portions 45 located at outer sides, thereby configuring the shield 40 in which the wires 11 to 14 arranged in the lateral direction are partitioned by the second walls 43.

First wires 11A to 11C are arranged at intervals in the wider one of left and right areas partitioned by the second wall 43, and the second wires 12A, 12B or the power supply wire 13 and the ground wire 14 are arranged at intervals in the narrower area. The upper and lower wire rows 16A, 16B are arranged such that the respective first wires 11A to 11C are at positions diagonal to each other (areas on distant sides). Note that the second wall 43 is not arranged between the respective first wires 11A to 11C, between the second wires 12A, 12B and between the power supply wire 13 and the ground wire 14 (not arranged for each individual wire).

(Shield Case 50)

Figure 1:
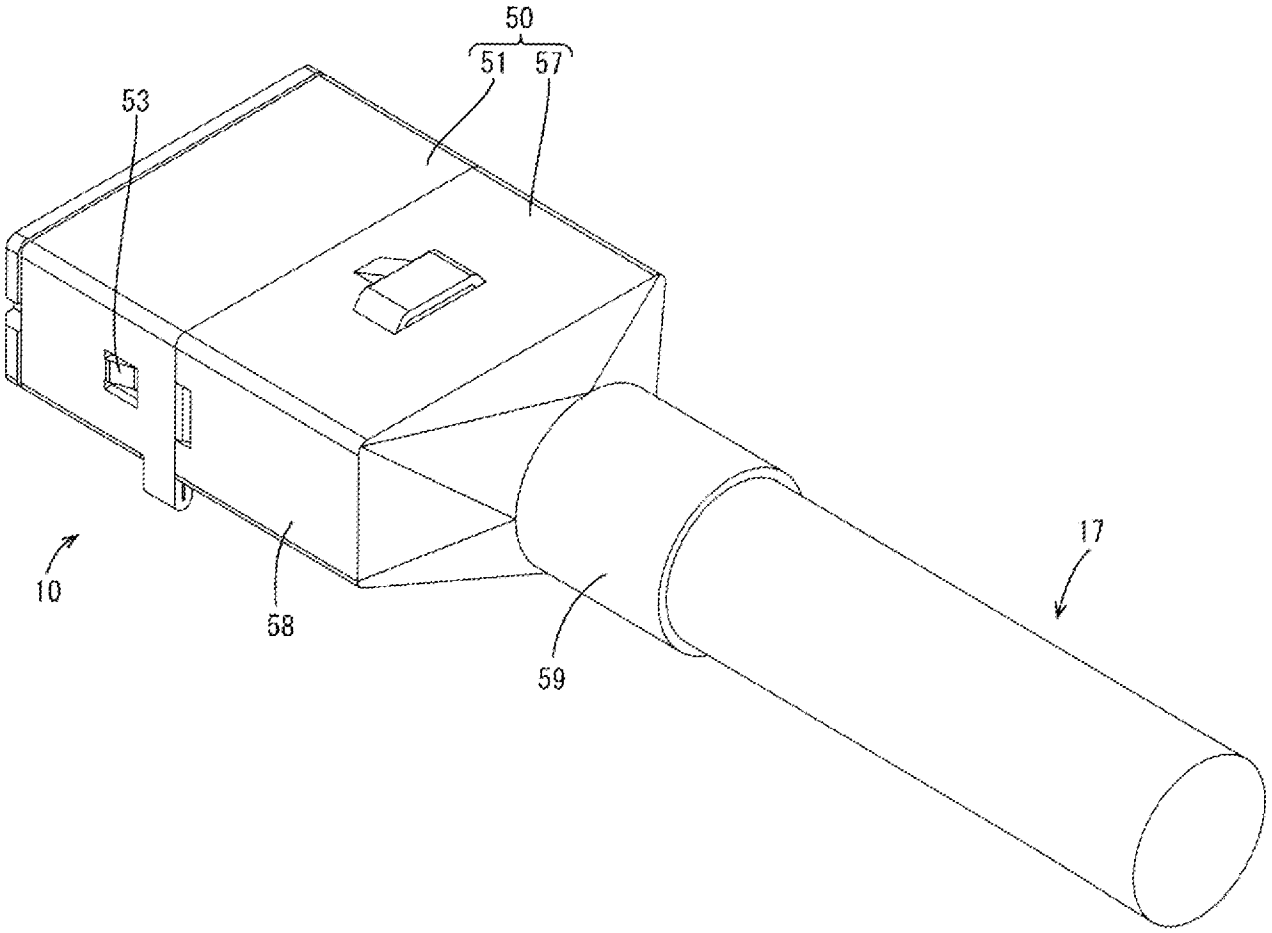
FIG. 1 is a perspective view showing a communication connector of a first embodiment connected to an end part of a shielded cable.
Figure 2:
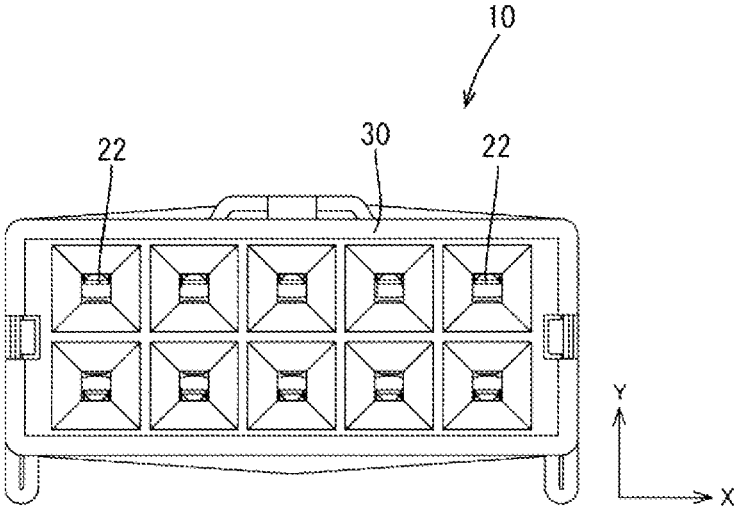
FIG. 2 is a front view showing the communication connector connected to the end part of the shielded cable.

As shown in FIG. 1, the shield case 50 includes a first shield case 51 for covering the body 31 of the housing 30 and a second shield case 57 arranged behind the first shield case 51 for covering the wires 11 to 14. The first shield case 51 is made of metal such as aluminum or aluminum alloy and includes, as shown in FIG. 3, a housing surrounding portion 52 in the form of a rectangular tube for surrounding the housing 30 and coupling portions 54 to be connected to the second shield case 57. Locked portions 53 formed of resiliently deformable resilient pieces are provided on left and right side surfaces of the housing surrounding portion 52. When the first shield case 51 is fitted into the housing 30 from behind the housing 30, the locked portions 53 are locked to locking portions 33 (see FIG. 7) formed by cutting side surfaces of the housing 30. The coupling portion 54 is a plate extending rearward from the rear end of the side surface part of the housing surrounding portion 52 and includes a locking piece 55. The locking piece 55 is resiliently deformable and is connected electrically to the second shield case 57 by contacting an inner surface of the second shield case 57.

The second shield case 57 is made of metal such as aluminum or aluminum alloy and includes, as shown in FIG. 1, a box-shaped wire shielding portion 58 open forward and a hollow cylindrical shield connecting portion 59 to be fit externally on the shielded cable 17. The wire shielding portion 58 surrounds all of the wires 11 to 14. The shield connecting portion 59 is connected, for example, to the shield layer folded outside the insulation coating 15 at the end part of the shielded cable 17. The shield connecting portion 59 and the shield layer can be fixed, for example, by welding or crimping.

According to this embodiment, the following functions and effects are exhibited.

According to this embodiment, the conductive shield 40 is arranged between the plurality of wires 11 to 14 for transmitting communication signals. Thus, the effect of noise on the wires 11A to 11C, 12A, 12B, 13 and 14 is suppressed.

Further, the wires 11 to 14 include the USB 3.0 first wires 11A to 11C and the USB 2.0 second wires 12A, 12B, and the shield 40 is arranged between the first wires 11A to 11C and the second wires 12A and 12B. Thus, the influence of noise between the first wires 11A to 11C and the second wires 12A, 12B can be suppressed.

Furthermore, the wires 11 to 14 include the USB 3.0 first wires 11A to 11C and the power supply wire 13 connected to the power supply, and the shield 40 is arranged between the first wires 11A to 11C and the power supply wire 13. Thus, the influence of noise on the first wires 11A to 11C by the power supply wire 13 can be suppressed.

Further, the wires 11 to 14 include the USB 3.0 first wires 11A to 11C, and the shield 40 is arranged between the first wires 11A to 11C. Thus, the influence of noise between the first wires 11A to 11C can be suppressed.

Furthermore, wire rows 16A, 16B are formed by arranging the wires 11 to 14 in parallel, and the shield 40 is arranged between the wire rows 16A, 16B. Thus, the influence of noise between the wire rows 16A, 16B can be suppressed.

Further, the shield 40 includes the first walls 42 arranged between the wire rows 16A, 16B and the second walls 43 standing on the first walls 42 and arranged between the wires 11 to 14 in each wire row 16A, 16B. Thus, the influence of noise between the wires 11 to 14 in the stages can be suppressed.

Furthermore, each wire row 16A, 16B includes the USB 3.0 first wires 11A to 11C and the first wires 11A to 11C partitioned by the second wall 43 in one of the wire rows 16A, 16B are arranged at positions diagonal to the first wires 11A to 11C in the different wire row 16B, 16A.

By diagonally arranging the first wires 11A to 11C of the different wire rows 16A, 16B in this way, the first wires 11A to 11C of the different wire rows 16A, 16B are arranged at distant positions. Thus, the influence of noise between the first wires 11A to 11C in the different wire rows 16A, 16B can be suppressed further.

Further, since the shield wall portion 40 is formed by connecting the plurality of partition plates 41, 41 in each of which the second wall portion 43 stands on the first wall portion 42, the shield wall portion 40 is easily formed.

Furthermore, since the shield 40 is fixed by being press-fit into the housing 30, the shield 40 can be fixed reliably to the housing 30 by a simple configuration.

Further, the shield case 50 covers the housing 30, and the shield 40 includes the case connecting portions 45 to be connected electrically connected to the shield case 50. Thus, a configuration for connecting the shield 40 to ground can be simplified.

Furthermore, the housing 30 includes the cavities 32 for accommodating the respective terminals 20. Thus, even if the communication connector 10 is installed in the vehicle, troubles such as due to the vibration of the vehicle can be suppressed.

A second embodiment of the invention is described with reference to FIGS. 14 to 25. The same components as in the first embodiment are denoted by the same reference signs and not described.

Although the shield 40 is formed from two partition plates 41, 41 in the first embodiment, a shield 70 formed by applying punching and bending to one metal plate material is used in a communication connector of the second embodiment.

Figure 20:
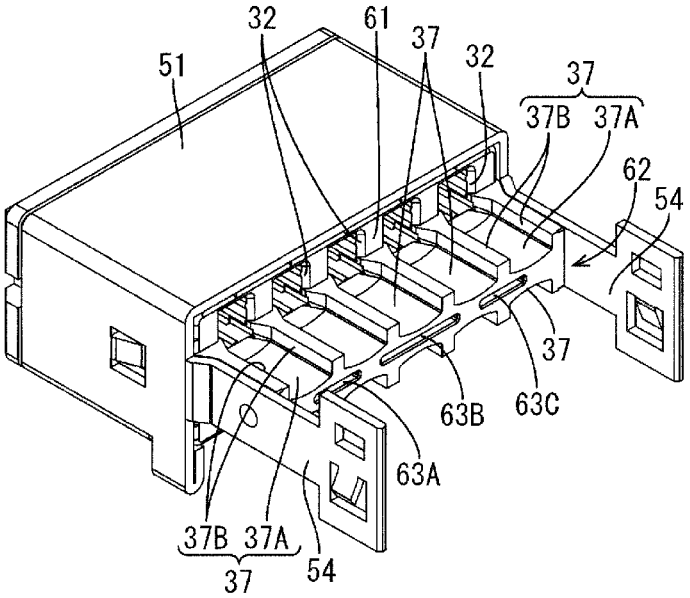
FIG. 20 is a perspective view showing a state where a first shield case is mounted in a housing.
Figure 21:
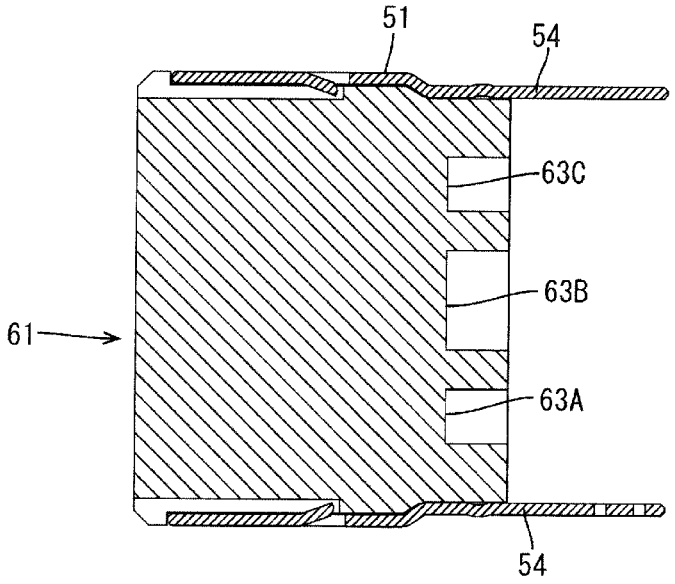
FIG. 21 is a plan view in section at the height of the press-fit holes in the state of FIG. 20.

As shown in FIGS. 20 and 21, an extending portion 62 extending rearward while having a smaller thickness than a housing 61 is formed with groove-like placing portions 37 arranged on the upper and lower surfaces of the extending portion 62 such that wire connecting portions 23 of respective terminals 20 can be placed thereon. Three press-fit holes 63A to 63C are formed at intervals on the rear end surface of the extending portion 62, with the middle press-fit hole 62B being wider than the other two press-fit holes 63A, 63C.

Figure 22:
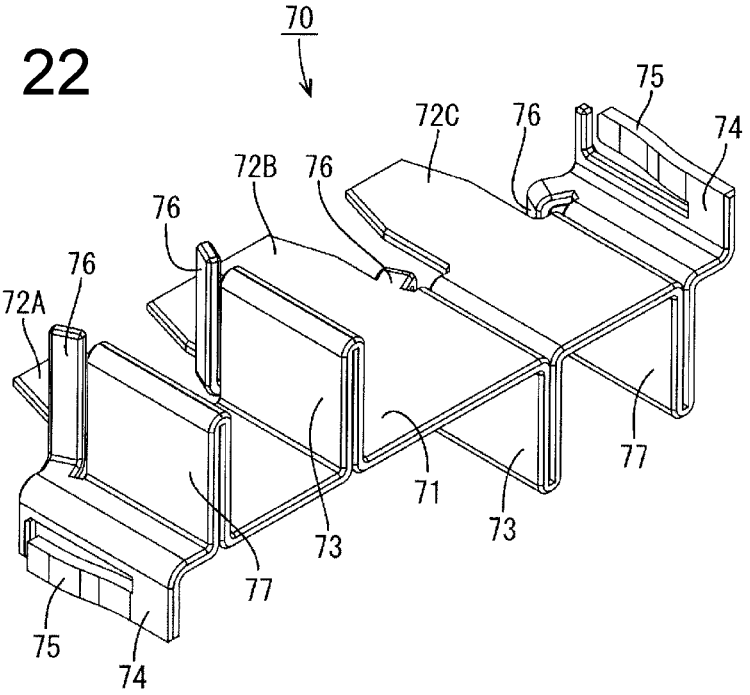
FIG. 22 is a perspective view showing a shield wall portion.
Figure 23:
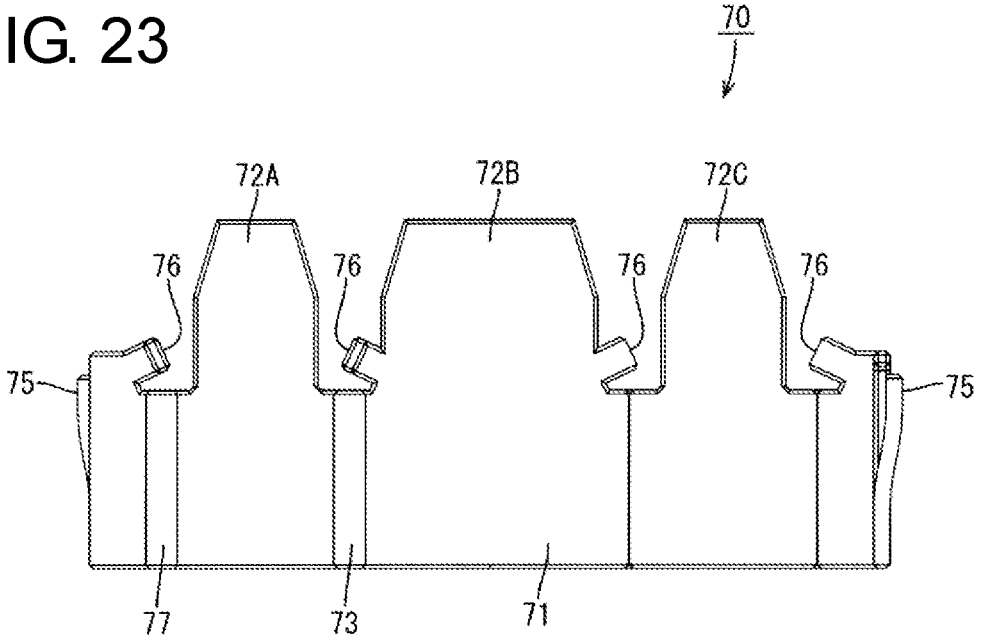
FIG. 23 is a plan view showing the shield wall portion.
Figure 24:
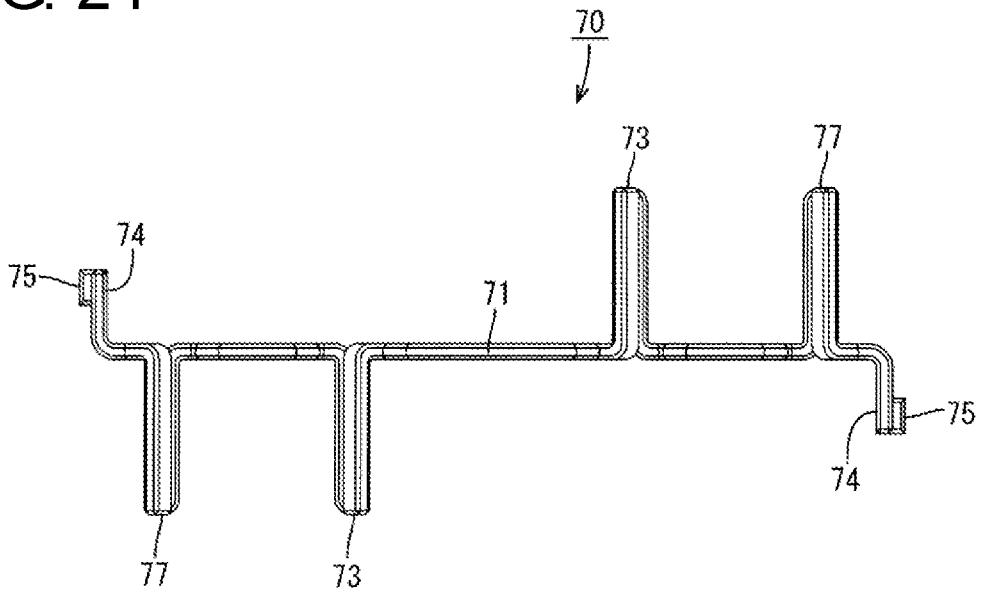
FIG. 24 is a front view showing the shield wall portion.
Figure 25:
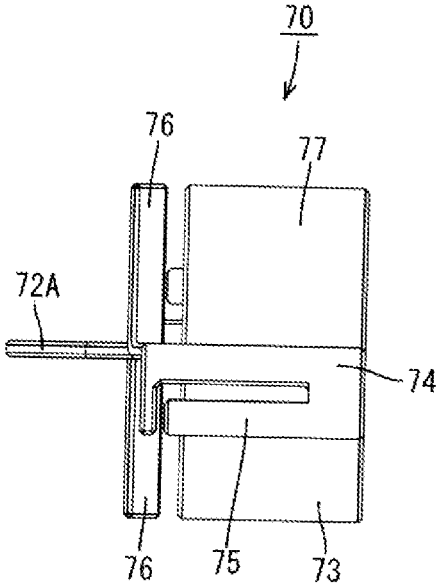
FIG. 25 is a side view showing the shield wall portion.

The shield 70 is made of aluminum, aluminum alloy, copper, copper alloy or the like and includes, as shown in FIG. 22, a first wall 71 extending in a lateral direction, three press-fitting portions 72A to 72C to be press-fit into the press-fit holes 63A to 63C and second walls 73, third walls 77 and case connecting portions 74 standing from the first wall 71. The first wall 71 is formed over the entire width of the housing 61 and is connected behind the extending portion 62. The second walls 73 stand up and down from the first wall 71, the upper second wall 73 is arranged on one side lateral to a middle part and the lower second wall 73 is arranged on the other side lateral to the middle part while being spaced apart. The second walls 73 are formed by folding the metal plate material.

Two second wires 12A, 12B are inserted between the second wall 73 and the third wall 77 on an upper side and three first wires 11A to 11C are inserted at intervals in a wide area at a right side of the upper second wall 73. A power supply wire 13 and a ground wire 14 are inserted between the second wall 73 and the third wall 77 on a lower side and the first wires 11A to 11C are inserted at intervals in a wide area at a left side of the second wall 73. Wire guides 76 for guiding the wires 11 to 14 to predetermined paths are formed in front of the second walls 73 and the third walls 77. The wire guides 76 extend in directions to widen a spacing between the second wall 73 and the third wall 77. The wires 11 to 14 can be guided while being protected by the wire guides 76 by having the outer peripheries thereof supported by the wire guides 76.

The middle press-fitting portion 72B is wider than the other two press-fitting portions 72A, 72C, and tip parts of the press-fitting portions 72A to 72C are slightly narrowed by having side edges of the tip parts obliquely cut. The shield 70 is fixed to the housing 61 by press-fitting the press-fitting portions 72A to 72C into the press-fit holes 63A to 63C (see FIG. 19).

Two of the case connecting portions 74 are provided on both side edge parts of the first wall 71 and stand in mutually opposite directions from the first wall 71, and resiliently deformable resilient contact pieces 75 are cantilevered forward with rear sides as base ends.

A third embodiment of the present invention is described with reference to FIGS. 26 to 31.

Figure 26:
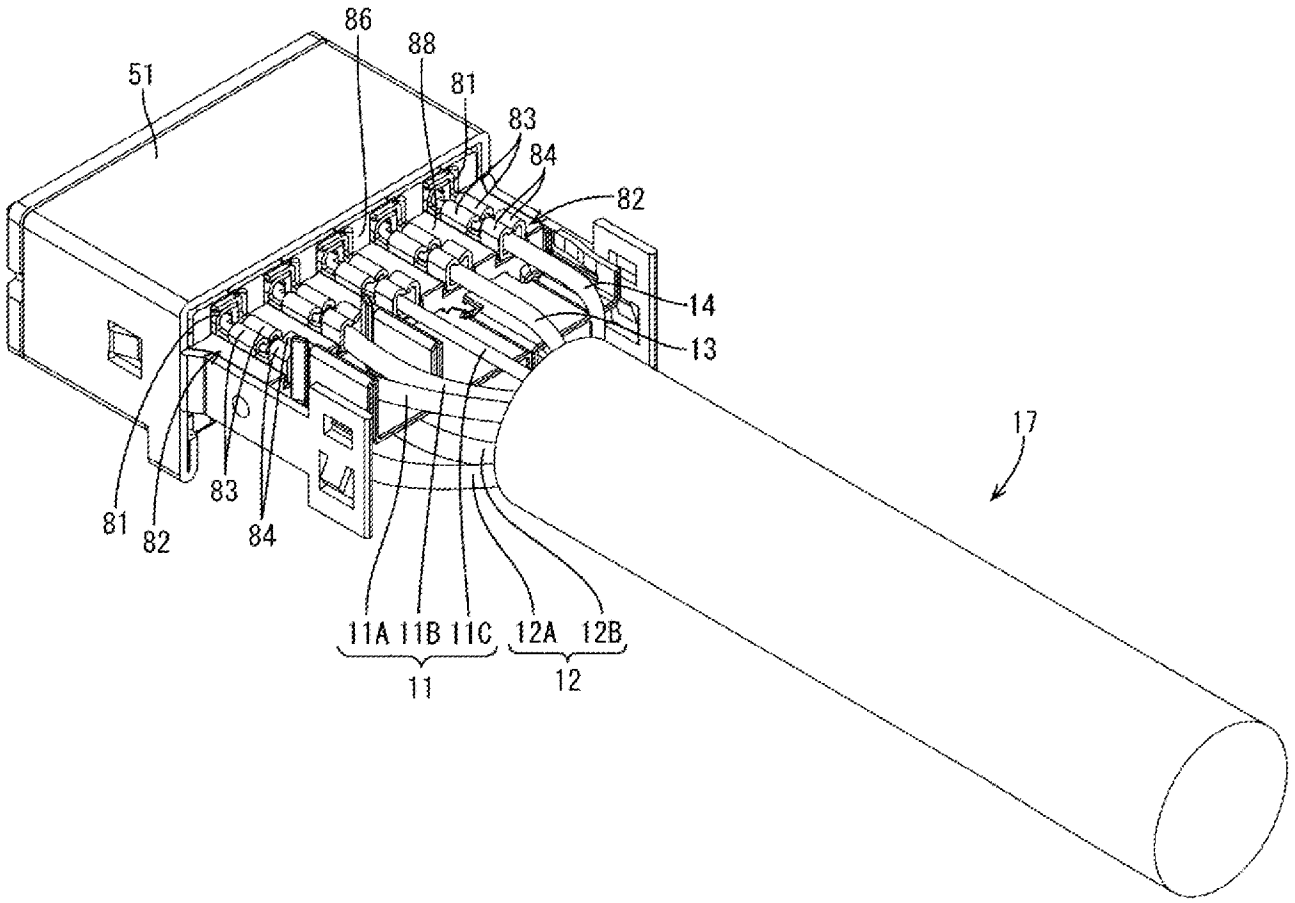
FIG. 26 is a perspective view showing a communication connector of a third embodiment connected to an end part of a shielded cable in a state where a second shield case is removed.
Figure 27:
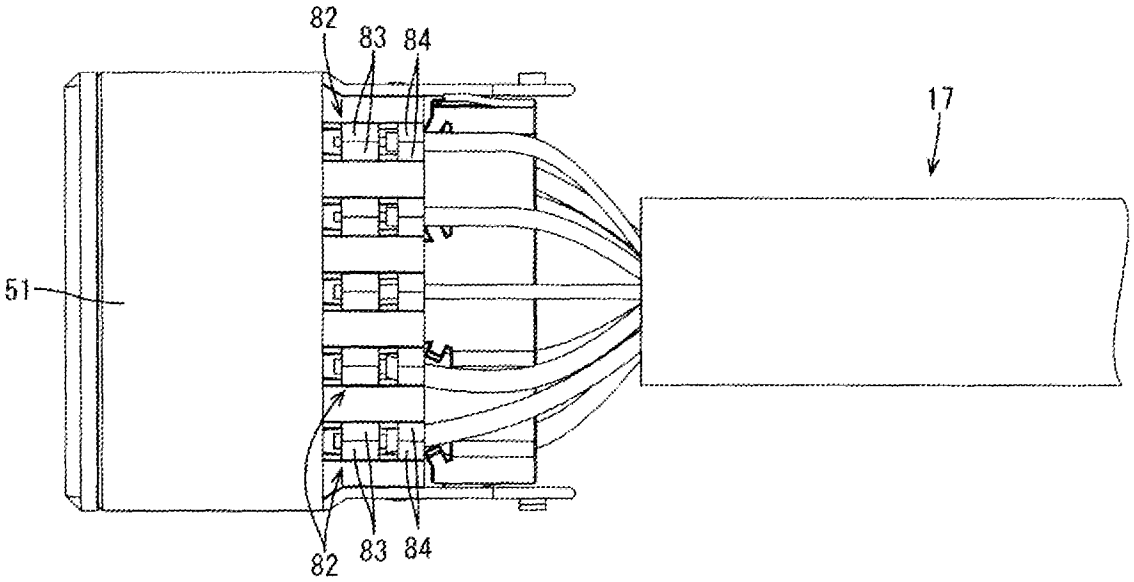
FIG. 27 is a plan view showing the communication connector connected to the end part of the shielded cable in the state where the second shield case is removed.
Figure 28:
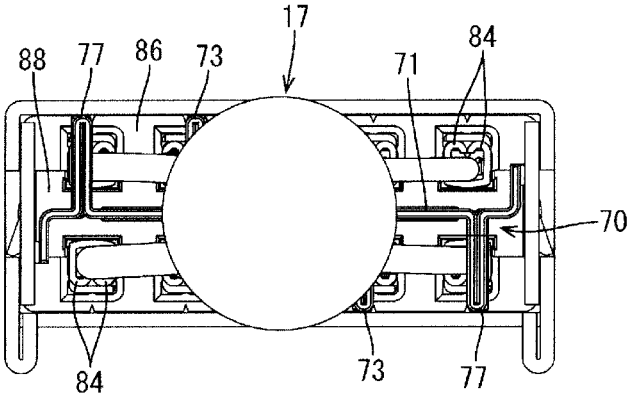
FIG. 28 is a back view showing the communication connector connected to the end part of the shielded cable in the state where the second shield case is removed.

In the third embodiment, wire connecting portions 82 of terminals 81 are crimped and connected to wires 11 to 14 as shown in FIG. 26. The same components as in the above embodiments are denoted by the same reference signs and not described.

The wire connecting portion 82 of the terminal 81 includes two wire barrel portions 83 and two insulation barrel portions 84 standing from both side edges of a bottom plate. The wire barrel portions 83 are crimped to a conductor exposed at an end part of the wire 11 to 14, and the insulation barrel portions 84 are crimped to hold an insulation coating of the wire 11 to 14.

Figure 29:
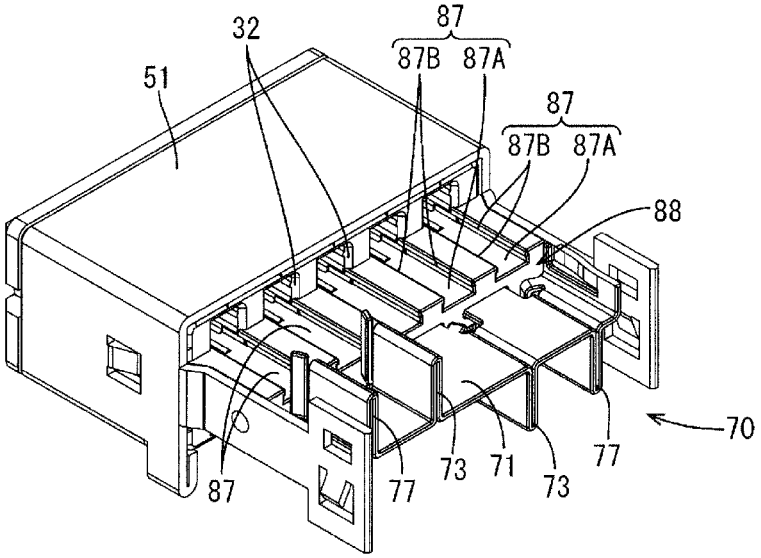
FIG. 29 is a perspective view showing the communication connector in a state where the second shield case, the shielded cable and terminals are removed.
Figure 30:
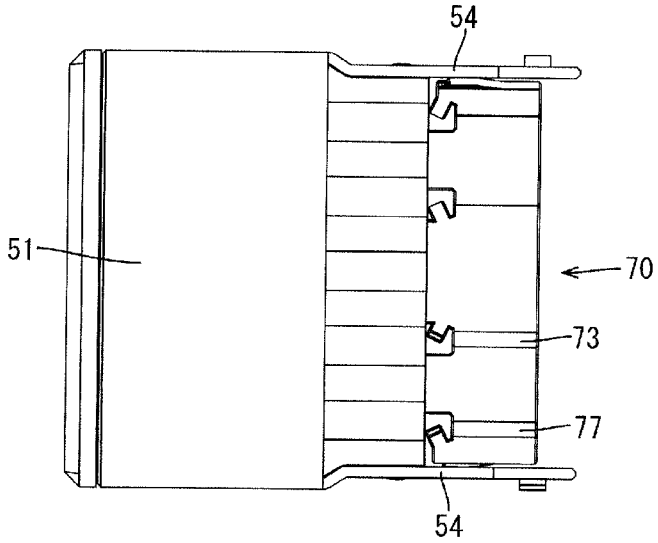
FIG. 30 is a plan view showing the communication connector in the state where the second shield case, the shielded cable and the terminals are removed.
Figure 31:
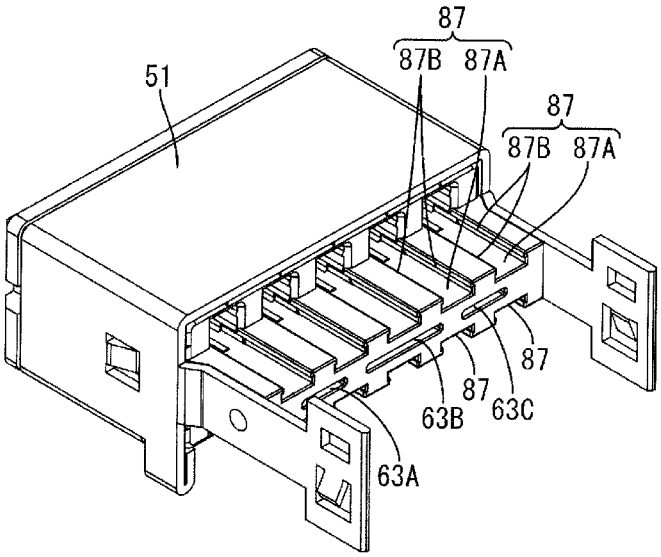
FIG. 31 is a perspective view showing a state where a first shield case is mounted in a housing.
Figure 32:
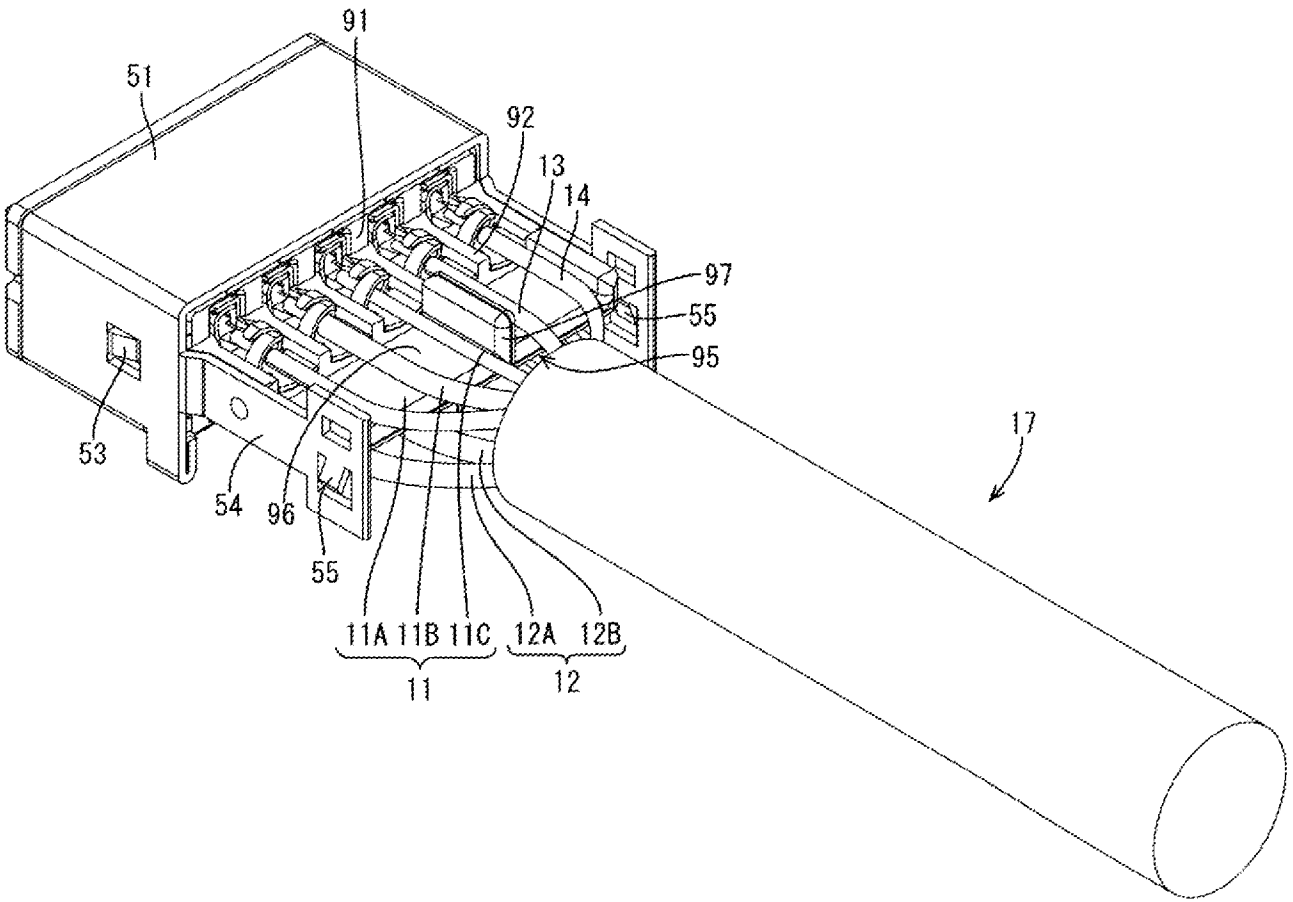
FIG. 32 is a perspective view showing a communication connector of a fourth embodiment connected to an end part of a shielded cable in a state where a second shield case is removed.
Figure 33:
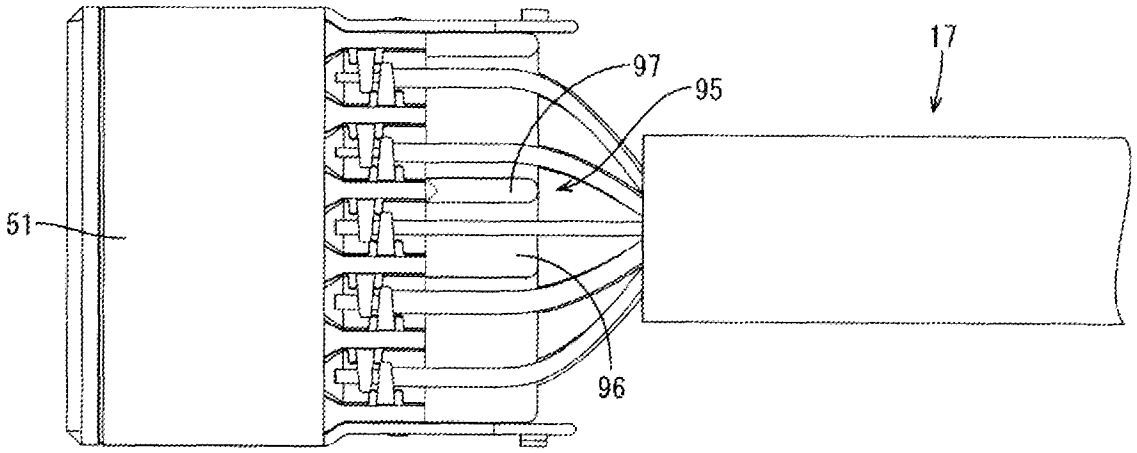
FIG. 33 is a plan view showing the communication connector connected to the end part of the shielded cable in the state where the second shield case is removed.
Figure 34:
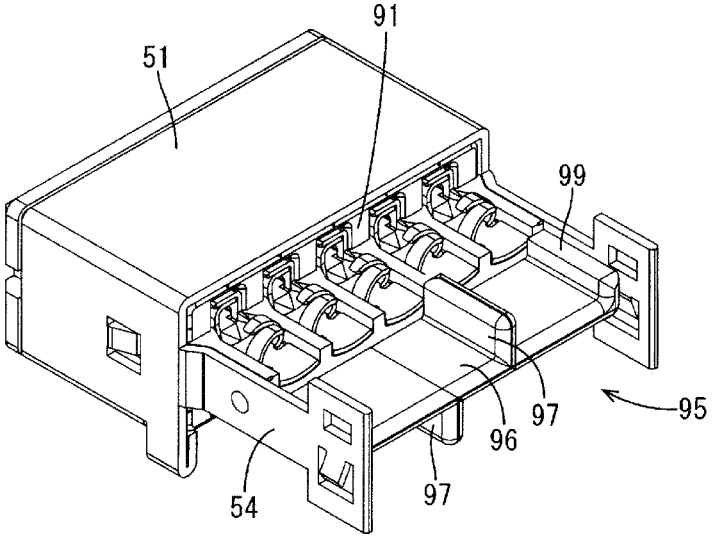
FIG. 34 is a perspective view showing the communication connector in a state where the second shield case and the shielded cable are removed.
Figure 35:
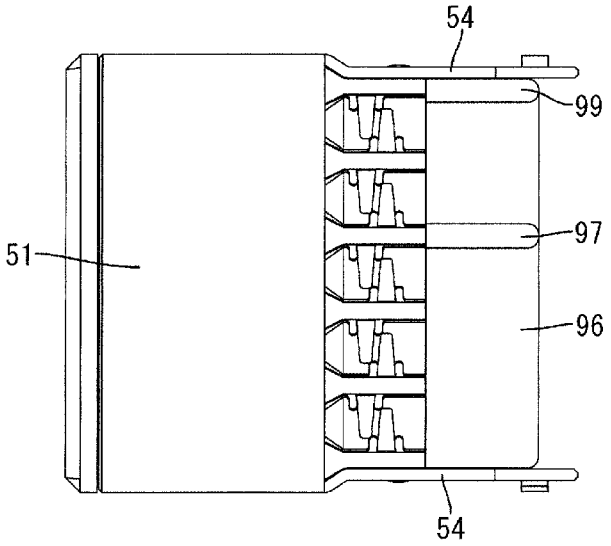
FIG. 35 is a plan view showing the communication connector in the state where the second shield case and the shielded cable are removed.
Figure 36:
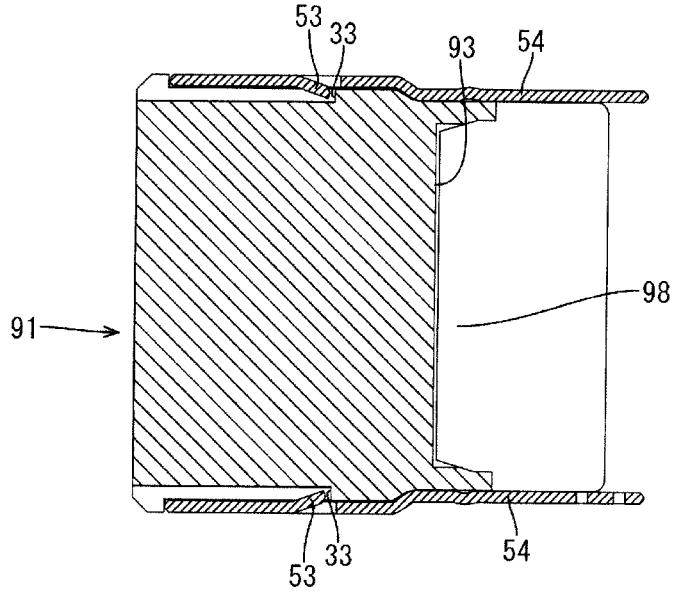
FIG. 36 is a plan view in section at a height of a press-fit hole in the state of FIG. 35.

An extending portion 88 extends rearward while having a smaller thickness than a housing 86. The extending portion 88 is formed with a plurality of placing portions 87 arranged on the upper and lower surfaces of the extending portion 88 such that the wire connecting portions 82 are placed thereon as shown in FIG. 29. Each placing portion 87 is formed into a groove shape corresponding to a width of the wire connecting portion 82 and includes a bottom surface 87A and groove walls 87B standing from both side edges of the bottom surface 87A, and the wire connecting portion 82 is fitted into the placing portion 87.

A fourth embodiment of the invention is described with reference to FIGS. 32 to 42.

The communication connector of the fourth embodiment, a shield 95 is formed of conductive resin. The same components as in the above embodiments are denoted by the same reference signs and not described.

Figure 37:
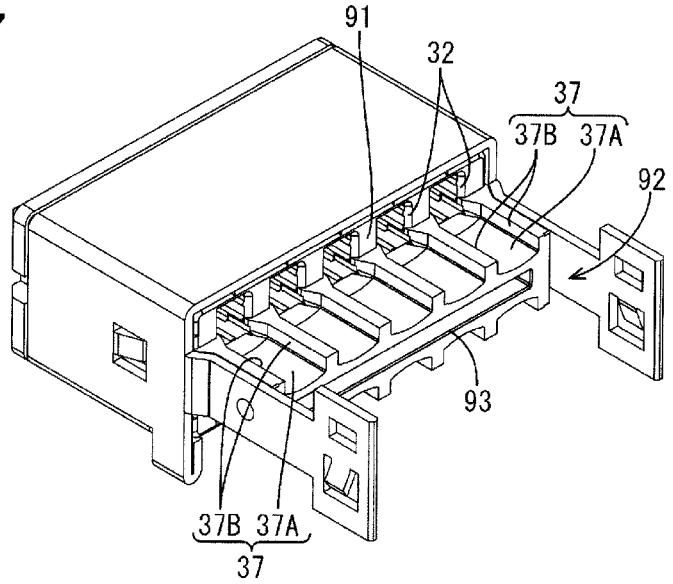
FIG. 37 is a perspective view showing a state where a first shield case is mounted in a housing.
Figure 38:
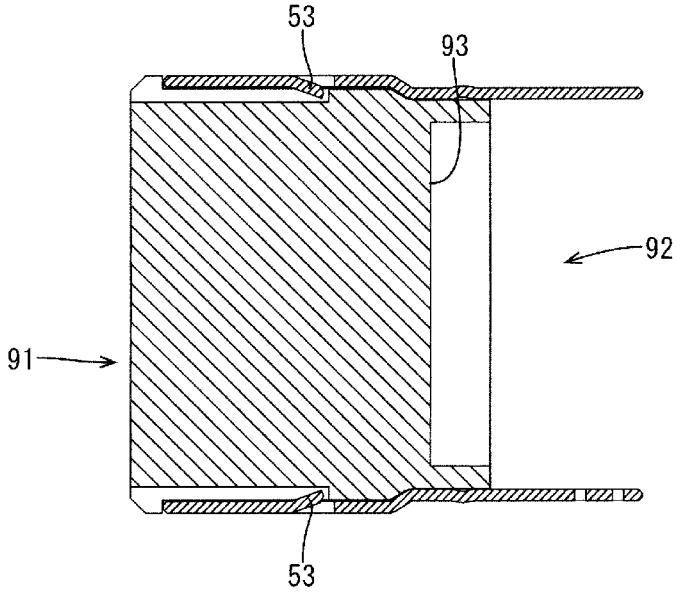
FIG. 38 is a plan view in section at the height of the press-fit hole in the state of FIG. 37.

As shown in FIGS. 37 and 38, the connector of the fourth embodiment has a housing 91 and an extending portion 92 extends rearward from the rear end surface of the housing 91 while having a smaller thickness than the housing 91. The extending portion is recessed to a predetermined depth over substantially the entire width of the housing 91, thereby forming a press-fit hole 93. A vertical hole dimension of the press-fit hole 93 is larger than those of the press-fit holes in the above embodiments.

Figure 39:
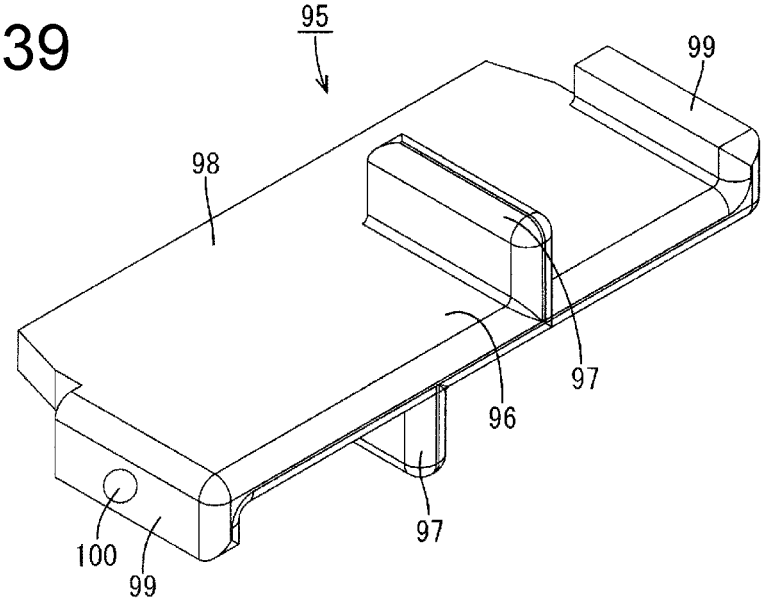
FIG. 39 is a perspective view showing a shield wall portion.
Figure 40:
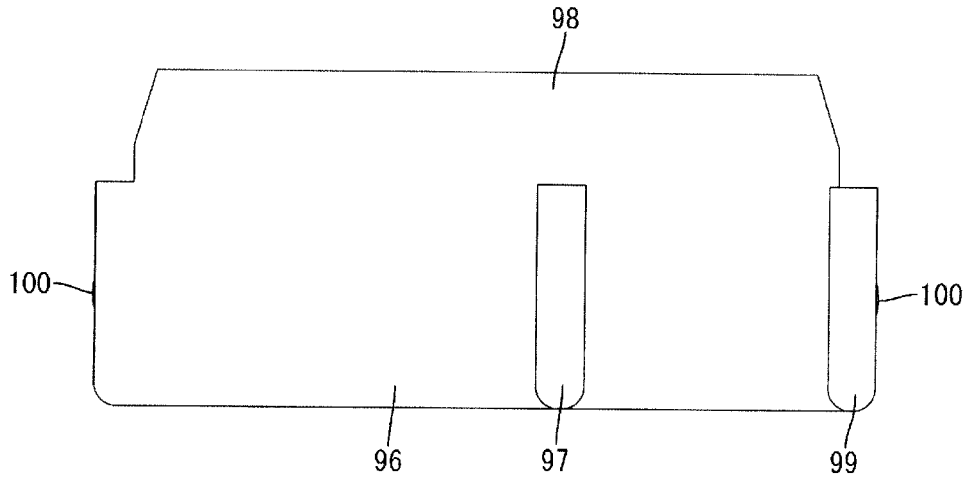
FIG. 40 is a plan view showing the shield wall portion.
Figure 41:
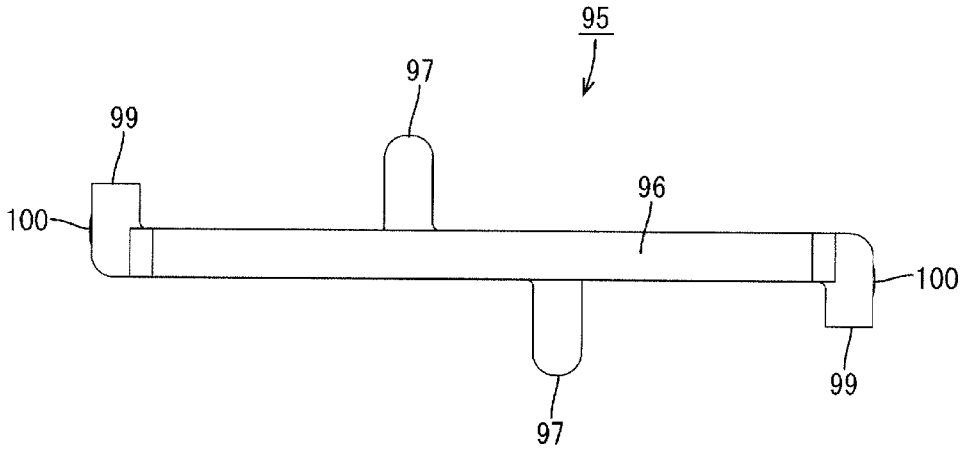
FIG. 41 is a front view showing the shield wall portion.
Figure 42:
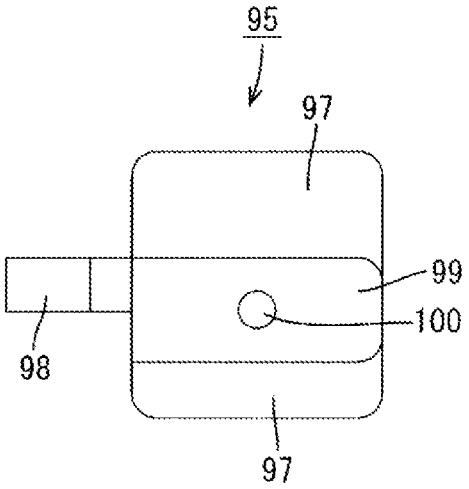
FIG. 42 is a side view showing the shield wall portion.

As shown in FIG. 39, the shield 95 includes a first wall 96 extending in a lateral direction while having a length corresponding to the width of the housing 91, second walls 97 standing on the first wall 96 to partition a plurality of wires 11 to 14, a press-fitting portion 98 to be press-fit into the press-fit hole 93 and case connecting portions 99 to be connected to a second shield case 57. Upper and lower second walls 97 are provided, the upper second wall 97 is arranged closer to one case connecting portion 99 than a laterally middle part and the lower second wall 97 is arranged closer to the other case connecting portion 99 than the laterally middle part.

The press-fitting portion 98 is connected in front of and flush with the first wall 96 and tip sides of left and right side edges are cut obliquely. The case connecting portions 99 stand in mutually opposite directions from both side edge parts of the first wall 96. Semispherical contact portions 100 configured to come into contact with inner surfaces of the second shield case 57 project on outer surfaces of the case connecting portions 99.

Various known conductive resins can be used as the one for forming the shield wall portion 95, and conductive plastic having conductivity derived from a polymer structure or conductive plastic having conductivity by adding an inorganic conductor to non-conductive plastic may be used.

According to the fourth embodiment, since the shield 95 is made of conductive resin, it is possible to shield between the wires while easily shaping the shield 95 by characteristics of the resin.

A fifth embodiment of the invention is described with reference to FIGS. 43 to 52.

The communication connector 110 of the fifth embodiment has shields 120 integrally formed to a first shield case 119 for covering a housing 112. The same components as in the above embodiments are denoted by the same reference signs and not described below.

Figure 43:
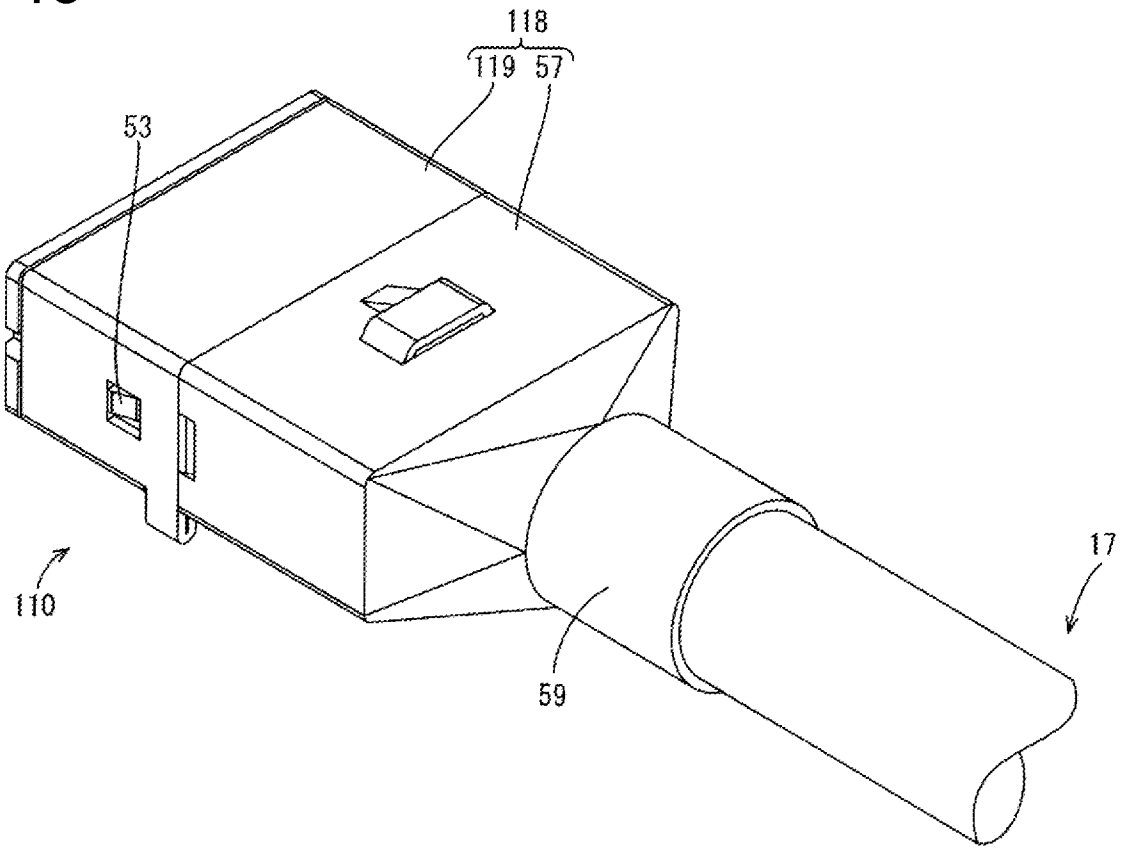
FIG. 43 is a perspective view showing a communication connector of a fifth embodiment connected to an end part of a shielded cable.
Figure 44:
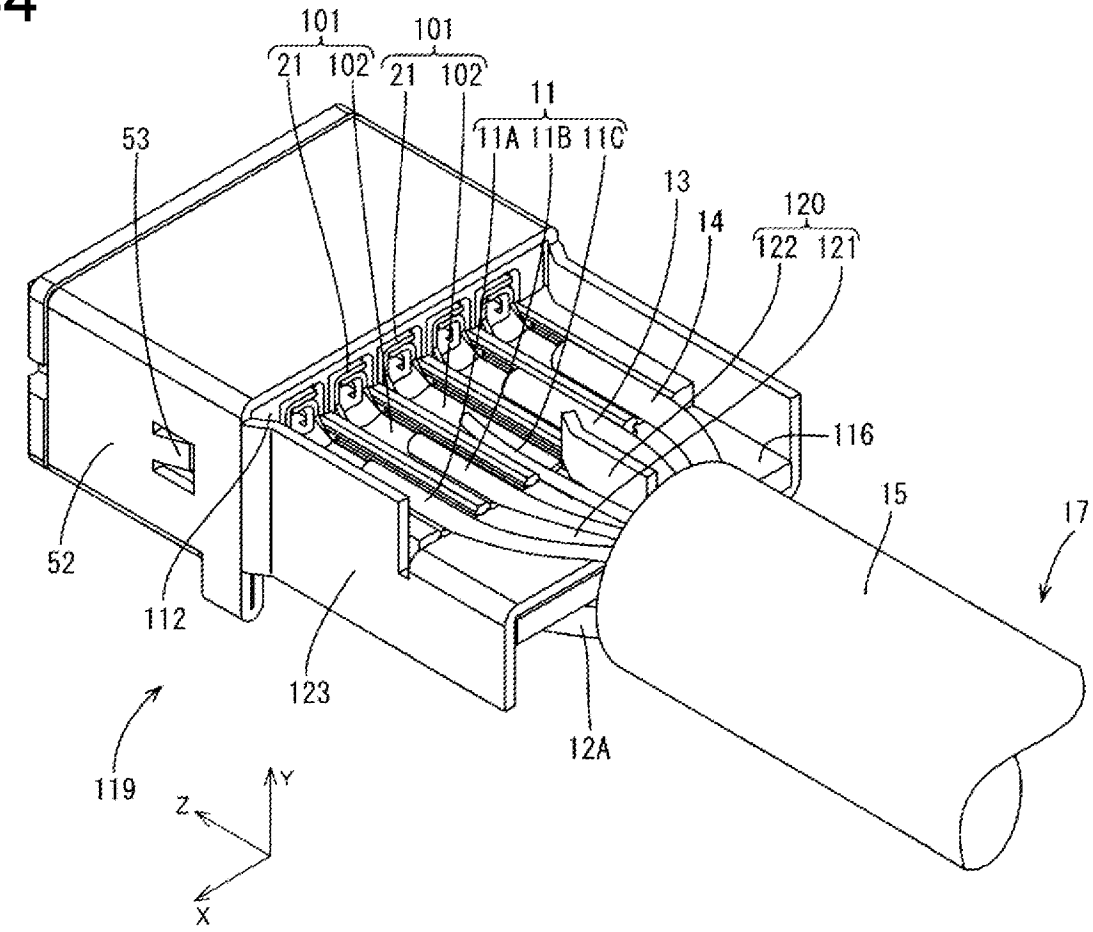
FIG. 44 is a perspective view showing the communication connector in a state where a second shield case is removed.
Figure 45:
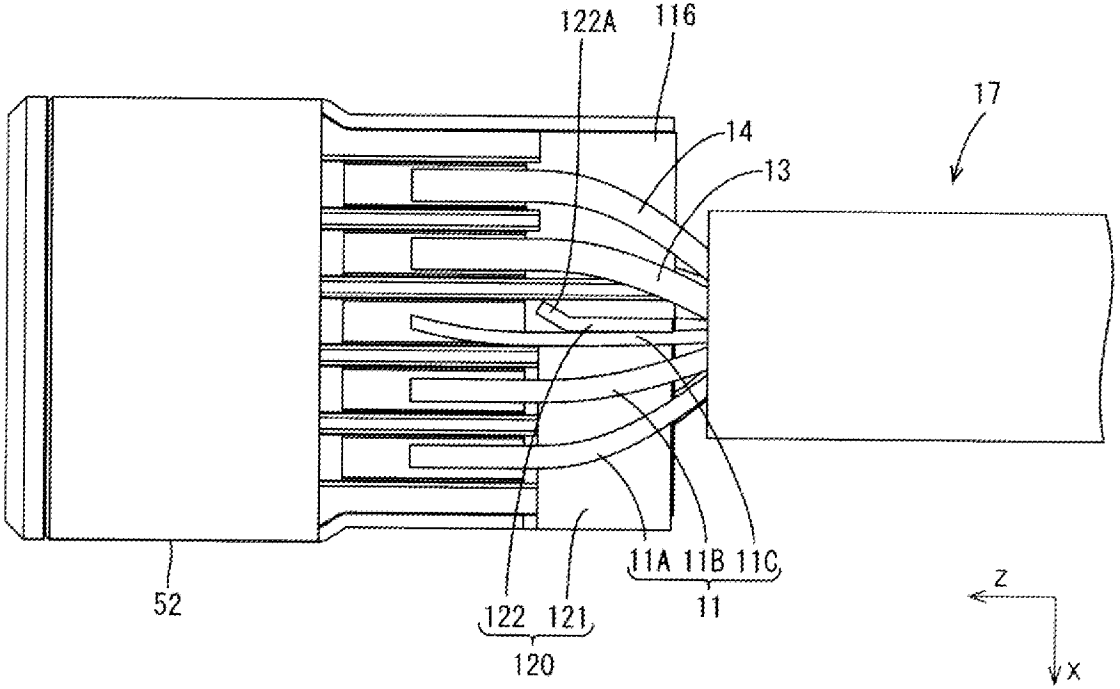
FIG. 45 is a plan view showing the communication connector in the state where the second shield case is removed.
Figure 46:
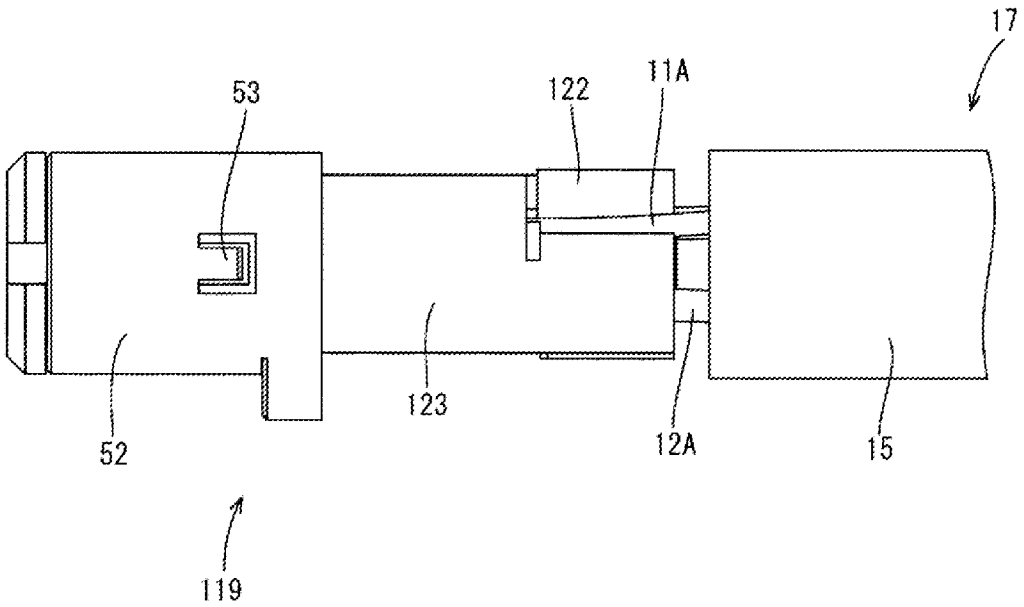
FIG. 46 is a side view showing the communication connector in the state where the second shield case is removed.

As shown in FIGS. 43 and 44, the communication connector 110 includes a shielded cable 17, terminals 101 (ten in this embodiment) connected to end parts of respective wires 11 to 14, the housing 112 for accommodating the terminals 101 and a shield case 118 for covering the housing 112 and the wires 11 to 14.

A front side of the terminal 101 serves as a terminal connecting portion 21 in the form of a rectangular tube, and a plate-like wire connecting portion 102 to be connected to a conductor exposed from the wire 11 to 14 is formed integrally behind the terminal connecting portion 21. The conductor of the wire 11 to 14 is connected to the wire connecting portion 102, for example, by soldering or welding.

(Shield Case 118)

Figure 50:
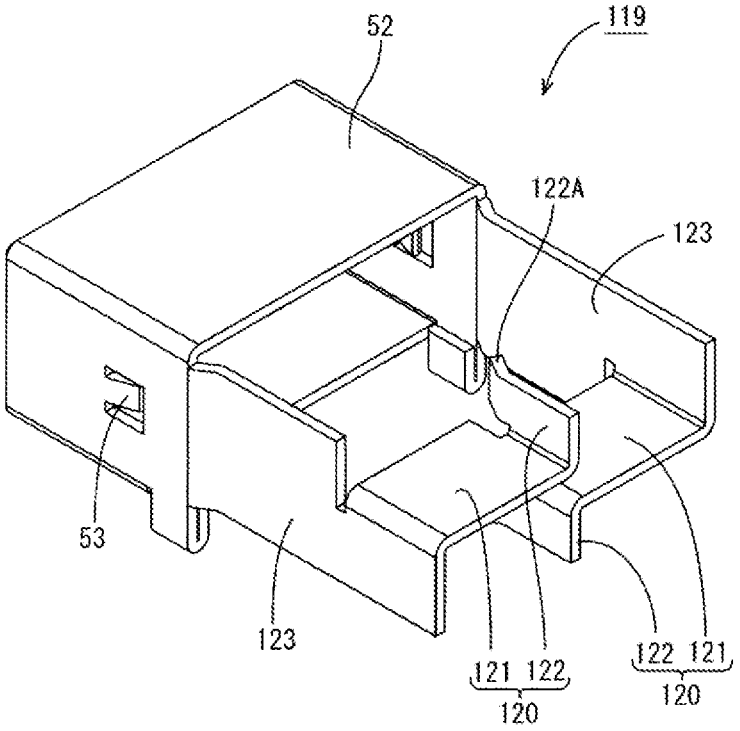
FIG. 50 is a perspective view showing a first shield case.
Figure 51:
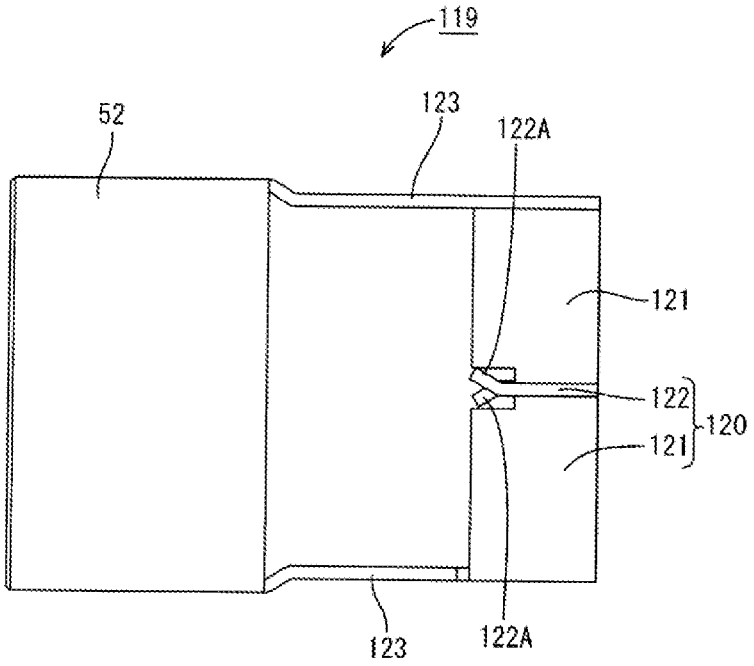
FIG. 51 is a plan view showing the first shield case.
Figure 52:
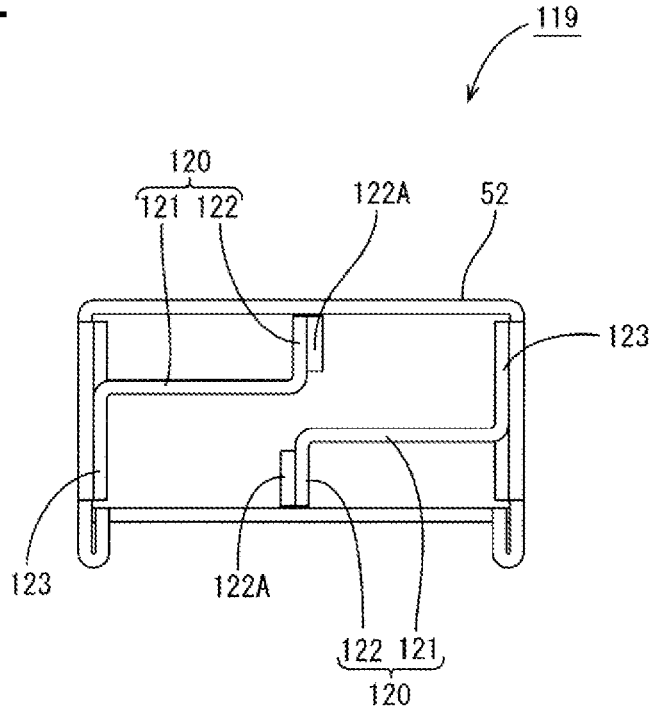
FIG. 52 is a back view showing the first shield case.

The shield case 118 includes the first shield case 119 for covering a body 31 of the housing 112 and a second shield case 57 arranged behind the first shield case 119 for covering the wires 11 to 14. The first shield case 119 is formed by applying punching and bending to a metal plate material, such as aluminum or aluminum alloy, and includes, as shown in FIG. 50, a housing surrounding portion 52 in the form of a rectangular tube for surrounding the housing 112, two shields 120 for shielding between the wires 11 to 14 and plate-like couplings 123 for coupling the housing surrounding portion 52 and each shield 120.

The two shields 120 are connected to the left and right couplings 123 and both include a plate-like first wall 121 extending in a lateral direction and a plate-like second wall 122 standing from one end edge of the first wall 121. The respective first walls 121 have a rectangular shape and are arranged in parallel to each other. The second wall 122 includes a bent portion 122A bent toward a side opposite to the first wall 121 connected to this second wall 122. First wires 11A to 11C are arranged at intervals in a wider one of left and right areas partitioned by the second wall 122, and second wires 12A, 12B or a power supply wire 13 and a ground wire 14 are arranged at intervals in the narrower area. The couplings 123 are formed to come into surface contact with inner side surfaces of the second shield case 57.

(Housing 112)

Figure 47:
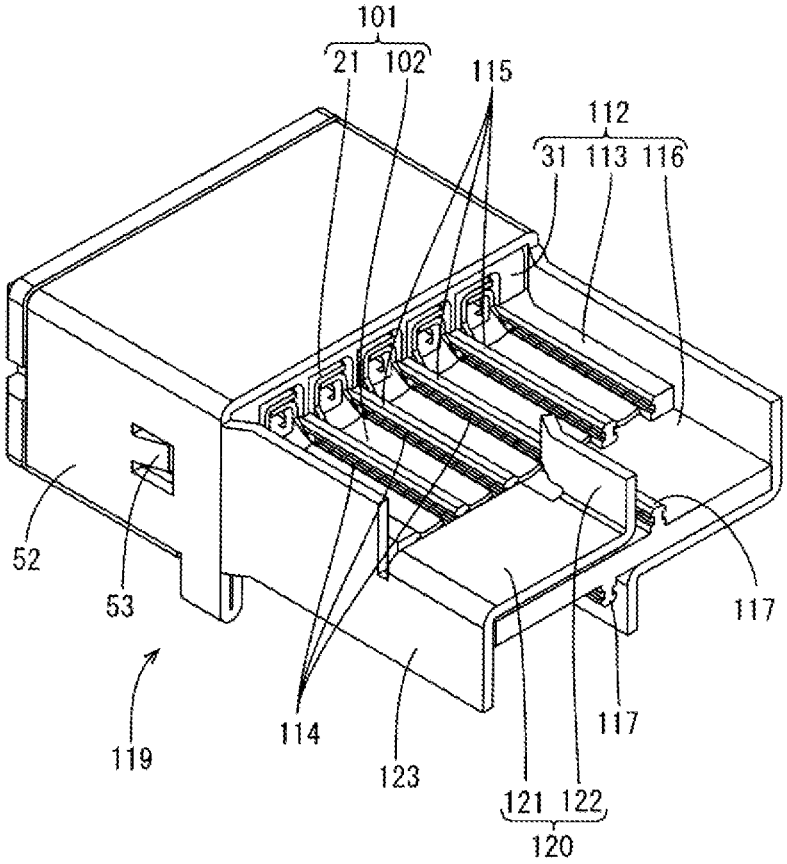
FIG. 47 is a perspective view showing the communication connector in a state where the second shield case and the shielded cable are removed.
Figure 48:
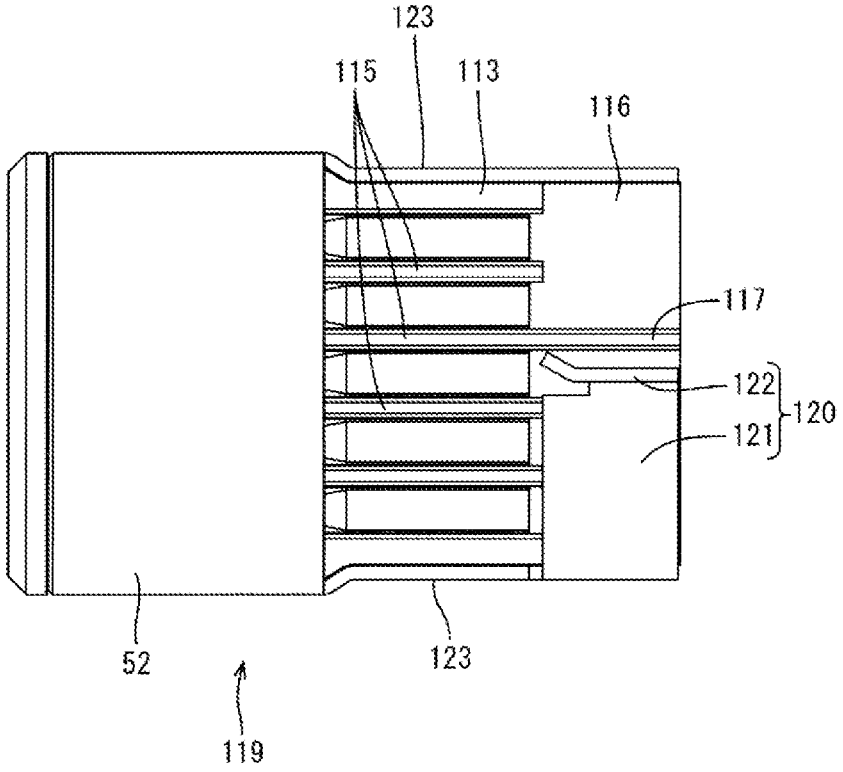
FIG. 48 is a plan view showing the communication connector in the state where the second shield case and the shielded cable are removed.
Figure 49:
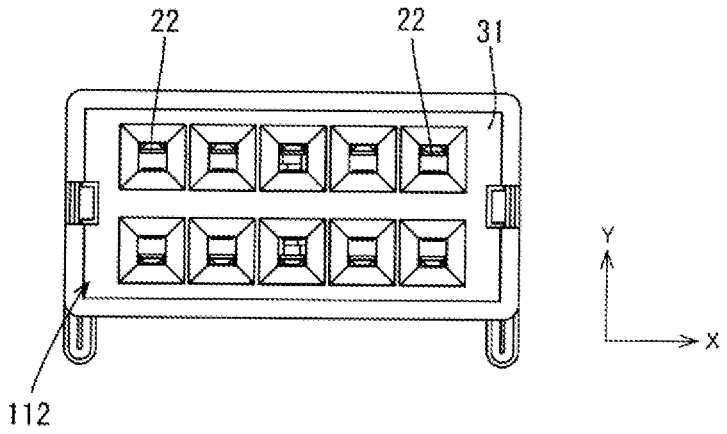
FIG. 49 is a front view showing the communication connector in the state where the second shield case and the shielded cable are removed.

The housing 112 is made of insulating synthetic resin and includes, as shown in FIGS. 47 and 48, the body 31 for accommodating terminal connecting portions 21 of the respective terminals 101, an extending portion 113 extending behind the body 31 while having a smaller vertical thickness than the body 31, and a plate-like support 116 extending behind the extending portion 113 while having a smaller vertical thickness than the extending portion 113.

The extending portion 113 is in the form of a plate extending rearward from a vertical middle part of the rear end of the body 31 and includes groove-like placing portions 114 arranged side by side such that the wire connecting portions 102 of the respective terminals 101 can be placed thereon. The placing portion 114 includes a bottom surface and groove walls standing from both side edges of the bottom surface, and elongated projections 115 extending in a front-rear direction between adjacent ones of the placing portions 114. The placing portions 114 are formed side by side in the lateral direction according to the number of the terminals 101 on each of the upper and bottom surfaces of the extending portion 113.

The support 116 is in the form of a rectangular plate, a thickness thereof is substantially equal to an interval between the upper and lower first walls 121 and the upper and lower surfaces thereof are connected to the bottom surfaces of the placing portions 114. Elongated projections 117 extend in the front-rear direction on the upper and lower surfaces of the support 116. The elongated projections 117 are connected behind the elongated projections 115 arranged between the first wires 11A to 11C and the second wires 12A, 12B or the power supply wire 13 and the ground wire 14. The elongated projections 117 have the same shape as the elongated projections 115. The elongated projection 117 comes into contact with the tip of the bent portion 122A of the shield 120 so that a resilient force of the bent portion 122A biases the coupling 123 of the first shield case 119 outwardly. In this way, the coupling 123 is pressed against the side surface of the second shield case 57 and the first shield case 119 and the second shield case 57 are connected electrically. Note that the couplings 123 of the first shield case 119 may be provided with locking pieces 55 for resilient locking as in the first embodiment and the first shield case 119 and the second shield case 57 may be electrically connected via the locking pieces 55.

The communication connector 110 can be assembled and formed, for example, by fitting the housing 112 having the terminals 101 mounted therein into the first shield case 119 from the front, fitting the second shield case 57 to the shielded cable 17 with the shield connecting portion 59 in the lead, and mounting the second shield case 57 at a predetermined position after the conductors of the firsts wires 11A to 11C and the like are welded to the terminals 101.

According to the fifth embodiment, the communication connector 110 includes the first shield case 119 for covering the housing 112 and the shields 120 are formed integrally to the first shield case 119. Thus, the number of components can be reduced as compared to the case of providing a shield separate from the shield case.

Further, since the housing 112 includes the support 116 for supporting the shields 120, the shields 120 can be held at predetermined positions with the deformation and the like thereof suppressed.

A sixth embodiment of the invention is described with reference to FIGS. 53 to 63. In the sixth embodiment, tubular portions 143A, 143B of a pair of shields 140A, 140B shield wires 11 to 14. The same components as in the above embodiments are denoted by the same reference signs and not described below.

Figure 53:
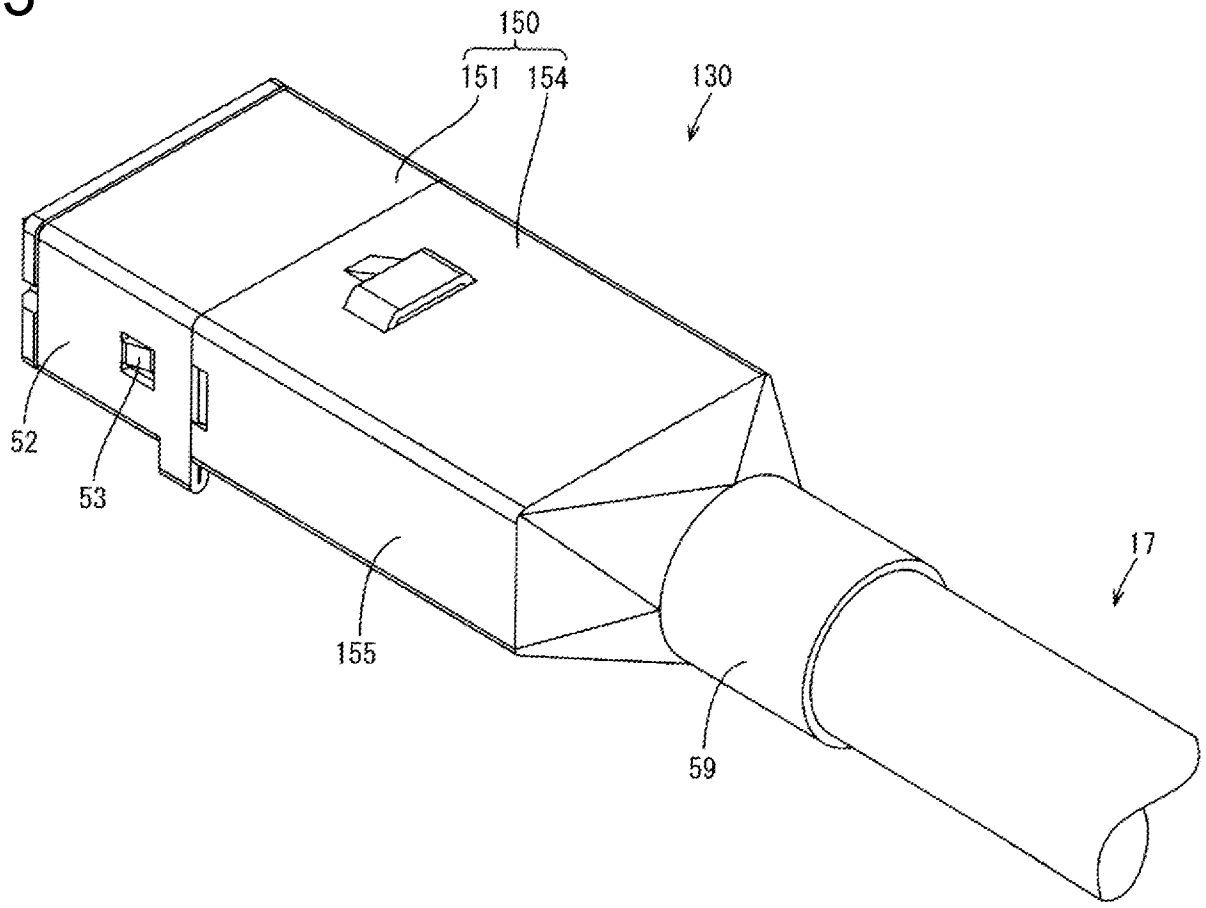
FIG. 53 is a perspective view showing a communication connector of a sixth embodiment connected to an end part of a shielded cable.
Figure 54:
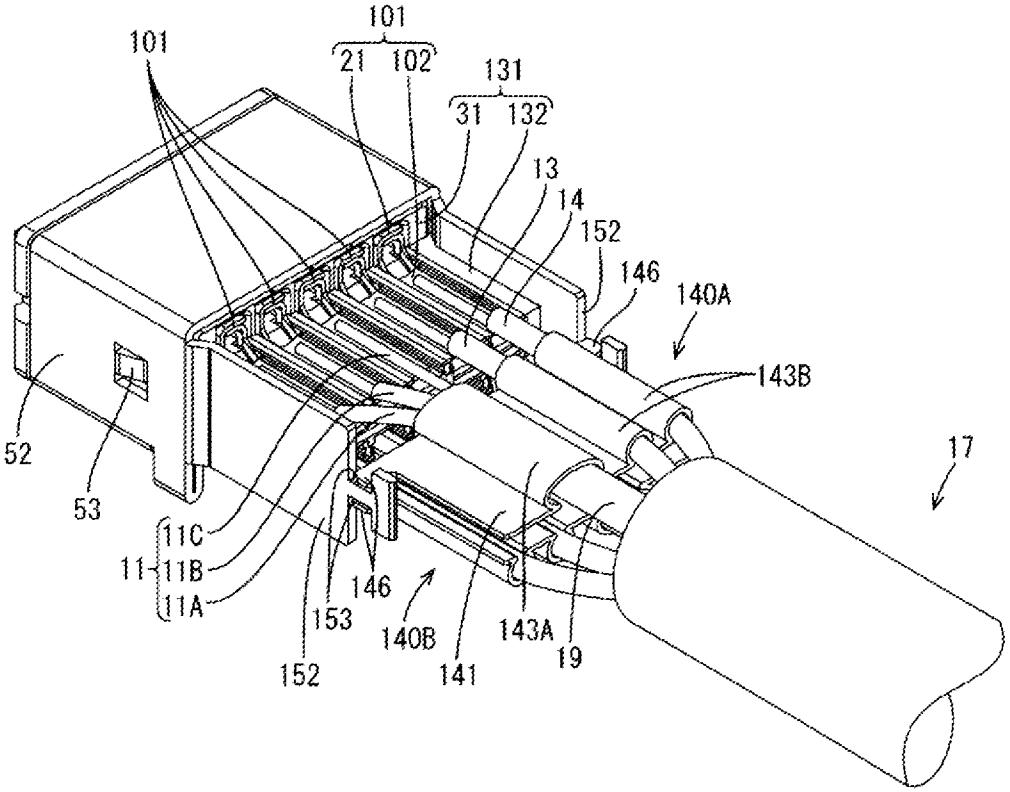
FIG. 54 is a perspective view showing the communication connector in a state where a second shield case is removed.

As shown in FIGS. 53 and 54, a communication connector 130 of this embodiment includes a shielded cable 17, terminals 101, the housing 131 for accommodating the terminals 101, the conductive shields 140A, 140B arranged behind the housing 131 and a shield case 150 for covering the housing 131 and the wires 11 to 14.

(Housing 131)

The housing 131 is made of insulating synthetic resin and includes a body 31 and an extending portion 132 extending behind the body 31 while having a small vertical thickness.

(Shields 140A, 140B)

Figure 56:
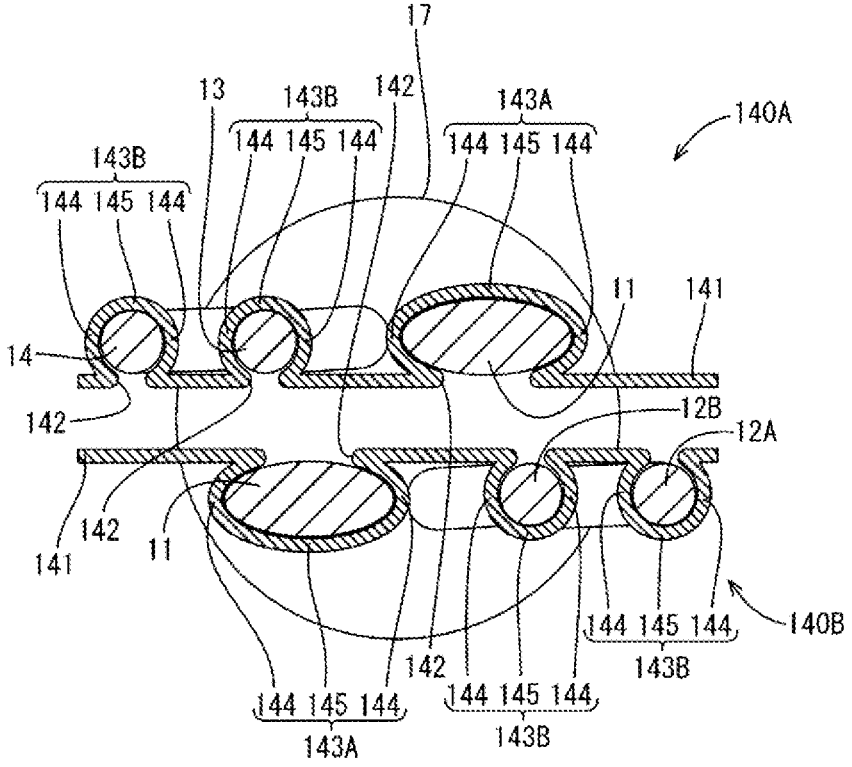
FIG. 56 is a section along A-A of FIG. 55.
Figure 57:
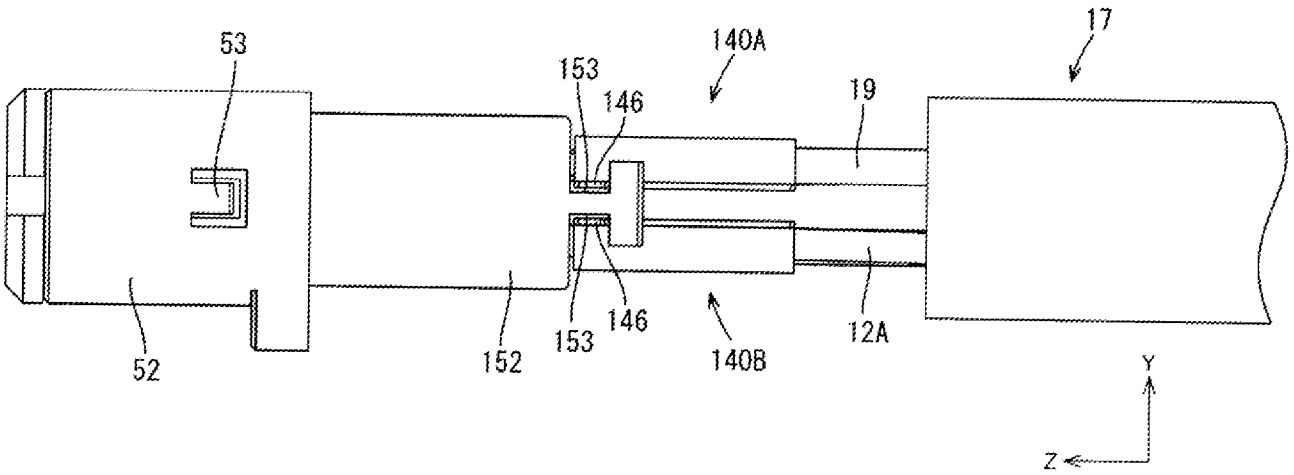
FIG. 57 is a side view showing the communication connector in the state where the second shield case is removed.

The two shields 140A, 140B are for shielding between wires 11 to 14, identically shaped and arranged opposite to each other with the front and back sides of one shield wall portion set opposite to those of the other. The shield 140A, 140B is formed by applying punching and bending to a metal plate material such as aluminum, aluminum alloy, copper or copper alloy and includes, as shown in FIG. 56, a first wall 141 extending in a lateral direction and the tubular portions 143A, 143B arranged around the wires 11 to 14. The first wall 141 is a rectangular plate and is formed with communication grooves 142 communicating with the interiors of the tubular portions 143A, 143B.

Figure 55:
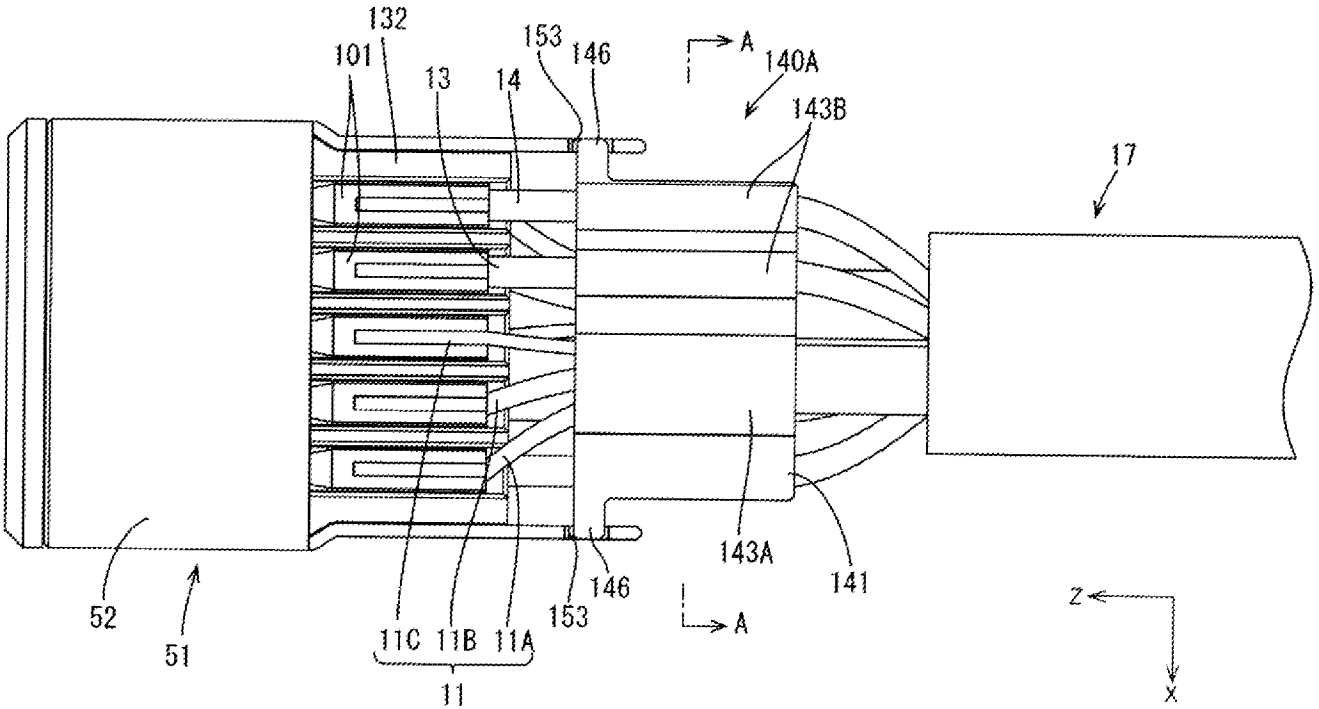
FIG. 55 is a plan view showing the communication connector in the state where the second shield case is removed.

The tubular portion 143A, 143B has a circular shape corresponding to the number of the wire(s) inserted therein and includes two second walls 144 standing from the first wall 141 and a coupling wall 145 connecting the second walls 144. First wires 11A to 11C in a shield layer 19 are inserted collectively into the tubular portion 143A (see FIG. 63), and a second wire 12A, 12B, a power supply wire 13 or a ground wire 14 is inserted individually into the tubular portion 143B. The tubular portion 143A contacts the shield layer 19 enclosing the first wires 11A to 11C so that the shield 140A, 140B is connected to a ground potential. As shown in FIG. 55, case connecting portions 146 project laterally to the first wall 141.

(Shield Case 150)

Figure 58:
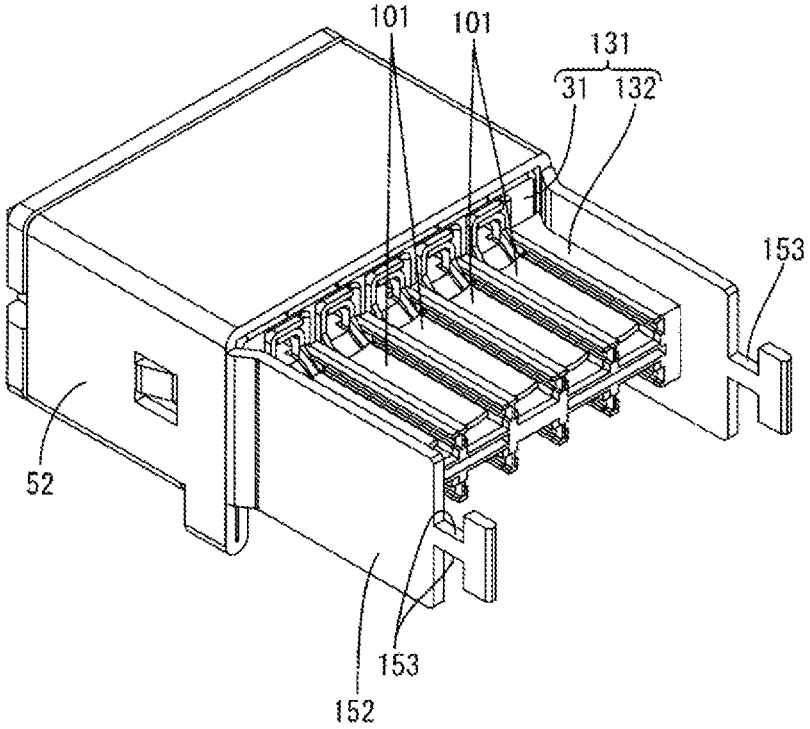
FIG. 58 is a perspective view showing the communication connector in a state where the second shield case and the shielded cable are removed.
Figure 59:
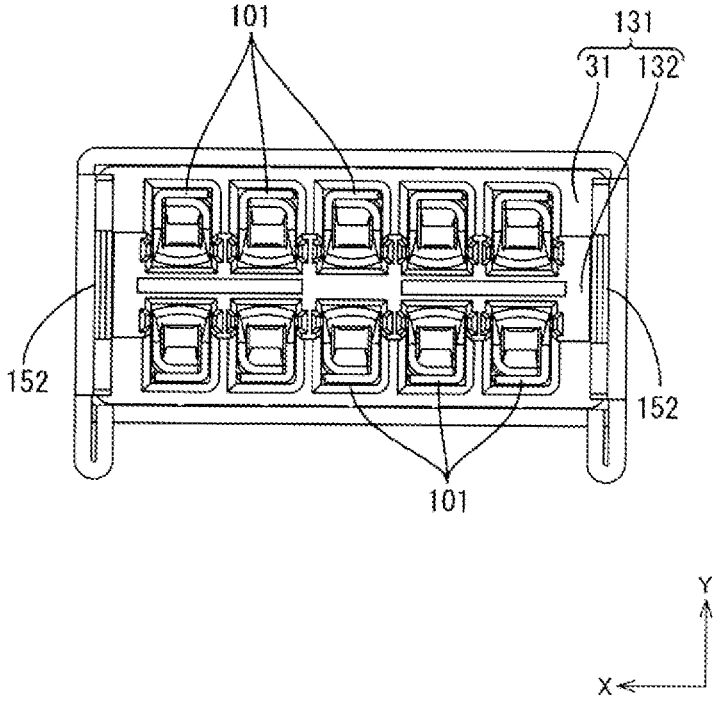
FIG. 59 is a back view showing the communication connector in the state where the second shield case and the shielded cable are removed.
Figure 60:
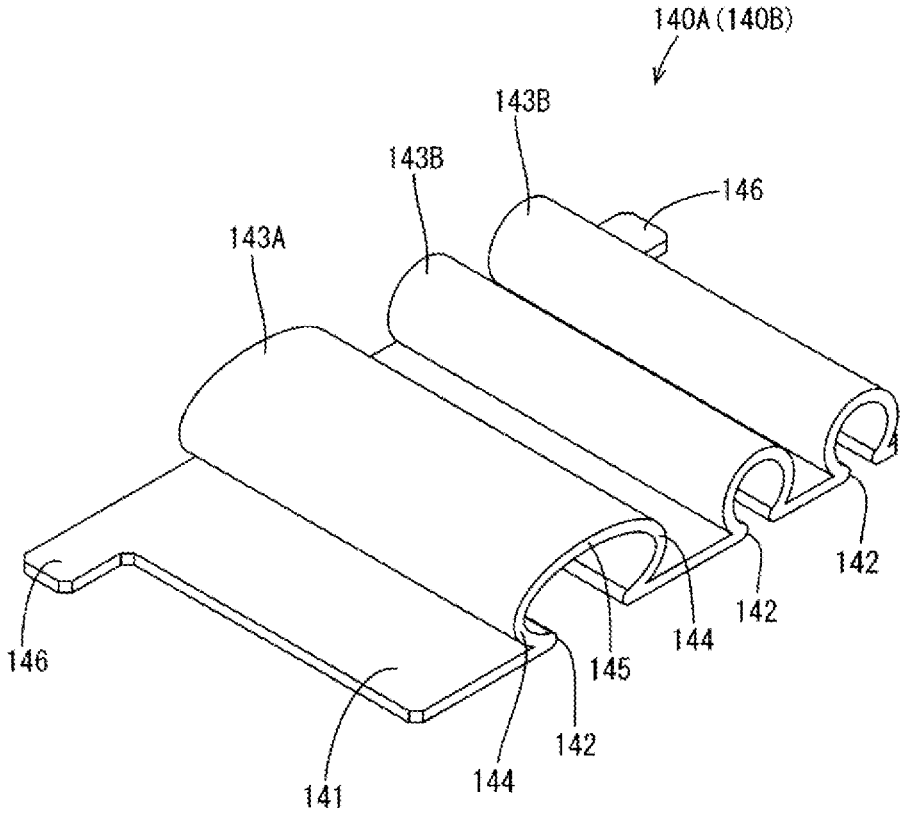
FIG. 60 is a perspective view showing a shield wall portion.
Figure 61:
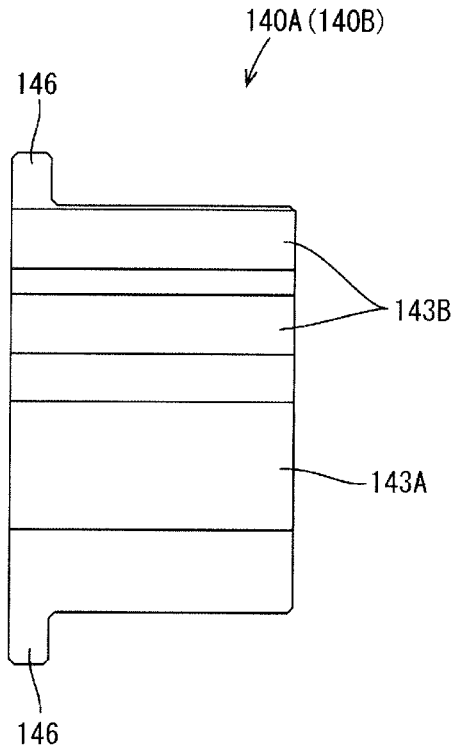
FIG. 61 is a plan view showing the shield wall portion.
Figure 62:
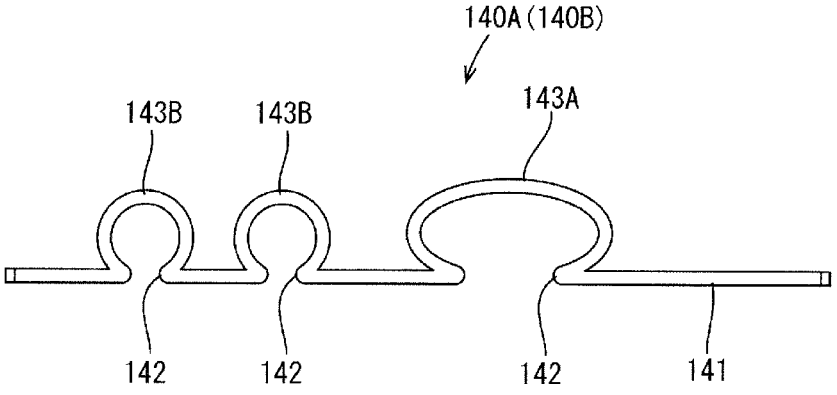
FIG. 62 is a front view showing the shield wall portion.
Figure 63:
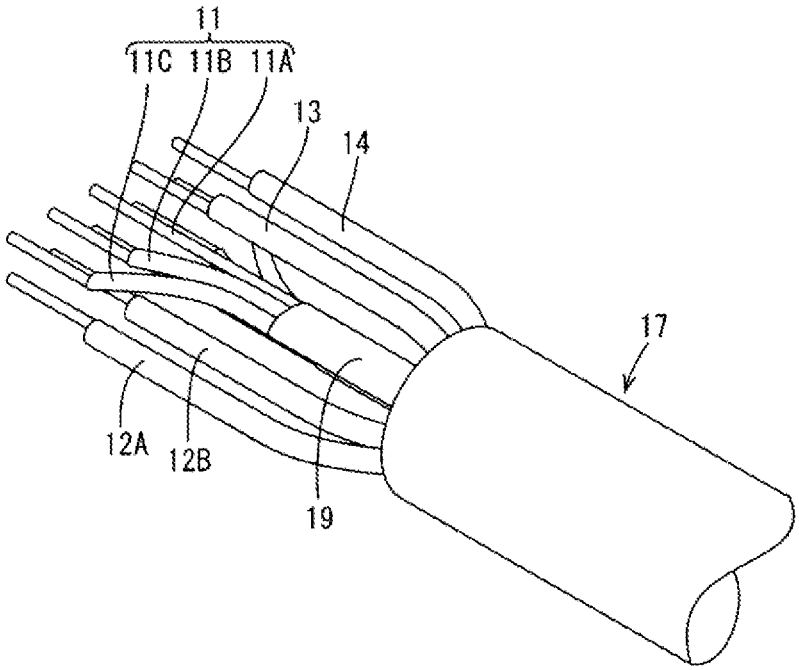
FIG. 63 is a perspective view showing the shielded cable.

As shown in FIG. 53, the shield case 150 includes a first shield case 151 for covering the body 31 of the housing 131 and a second shield case 154 arranged behind the first shield case 151 for covering the plurality of wires 11 to 14. The first shield case 151 is made of metal such as aluminum or aluminum alloy and includes, as shown in FIG. 54, a housing surrounding portion 52 and coupling portions 152 to be connected to the second shield case 154. As shown in FIG. 58, the coupling portion 152 is a plate extending rearward from the rear end of a side surface part of the housing surrounding portion 52 and includes upper and lower locking recesses 153. The shield case 150 and the shields 140A, 140B are connected electrically by locking the case connecting portions 146 in the locking recesses 153.

The second shield case 154 is made of metal, such as aluminum or aluminum alloy, and includes, as shown in FIG. 53, a box-shaped wire shielding portion 155 open forward and a hollow cylindrical shield connecting portion 59 to be fit externally on the shielded cable 17. The wire shielding portion 155 is shaped to be somewhat longer in the front-rear direction according to lengths of the shields 140A, 140B.

According to the sixth embodiment, the conductive coupling walls 145 couple the second walls 144 and cover the wires 11 to 14 between adjacent ones of the second walls 144. Thus, outer sides of the wires 11 to 14 between the second walls 144 can be shielded by the coupling walls 145.

A seventh embodiment of the invention is described with reference to FIGS. 64 to 78. In the seventh embodiment, a first wall 171 and tubular portions 173A, 173B are provided separately. The same components as in the above embodiments are denoted by the same reference signs and not described below.

Figure 64:
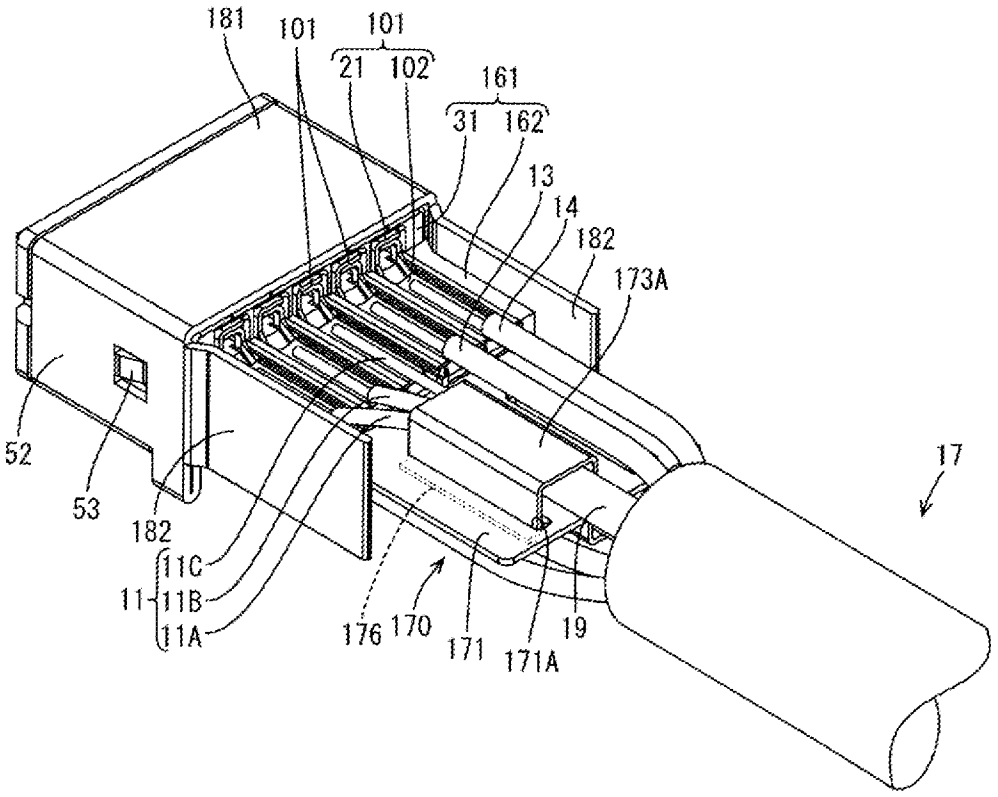
FIG. 64 is a perspective view showing a communication connector of a seventh embodiment in a state where a second shield case is removed.
Figure 65:
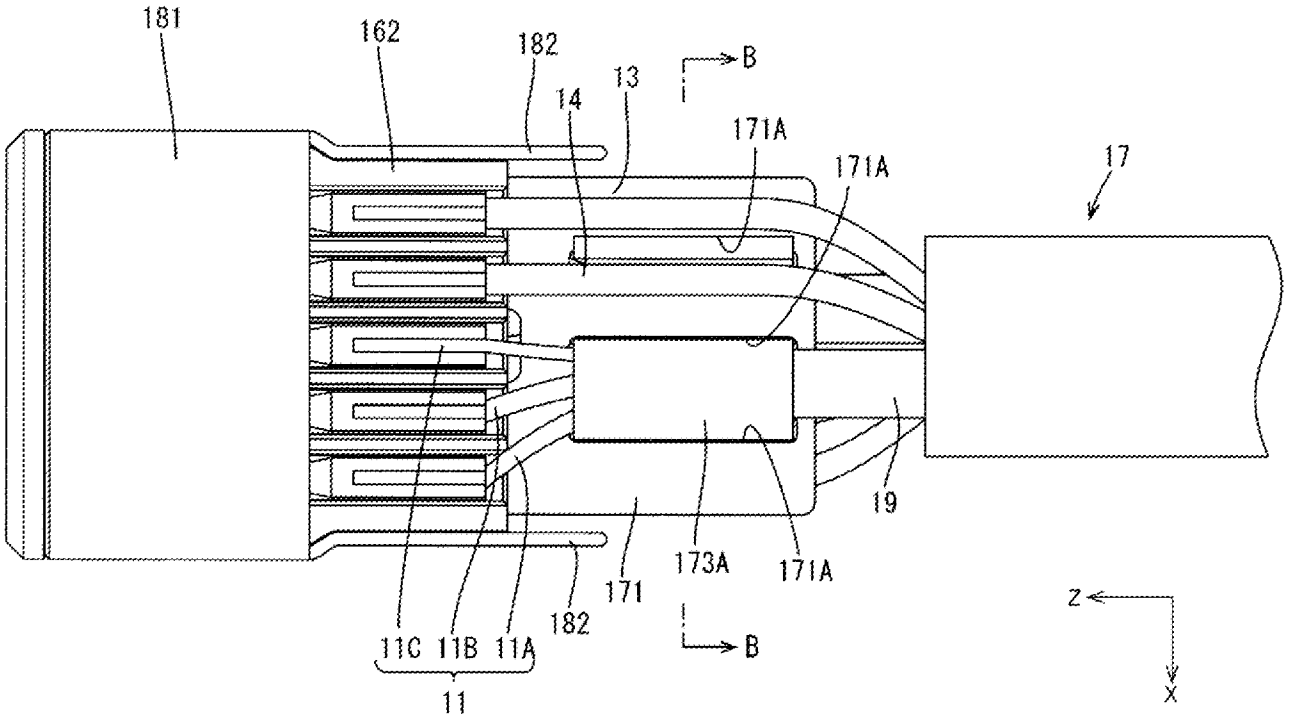
FIG. 65 is a plan view showing the communication connector in the state where the second shield case is removed.

As shown in FIG. 64, a communication connector of this embodiment includes a shielded cable 17, terminals 101, a housing 161 for accommodating the terminals 101, a conductive shield 170 arranged behind the housing 161 and a first shield case 181 for covering a body 31 of the housing 161. The first shield case 181 is made of metal such as aluminum or aluminum alloy and includes a housing surrounding portion 52 and a plate-like shield extending portion 182 extending rearward, and a second shield case 154 is mounted behind the first shield case 181.

(Housing 161)

Figure 74:
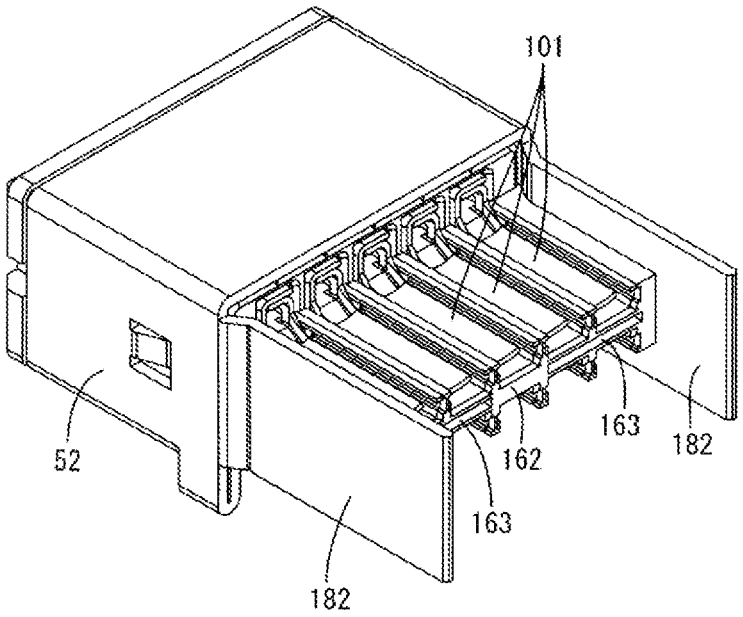
FIG. 74 is a perspective view showing a state where a first shield case is mounted on a housing having terminals accommodated therein.
Figure 75:
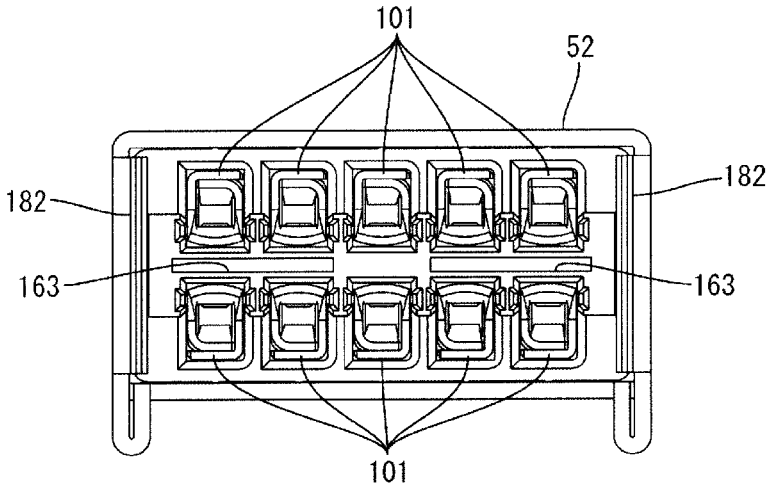
FIG. 75 is a back view showing the state where the first shield case is mounted on the housing having the terminals accommodated therein.
Figure 76:
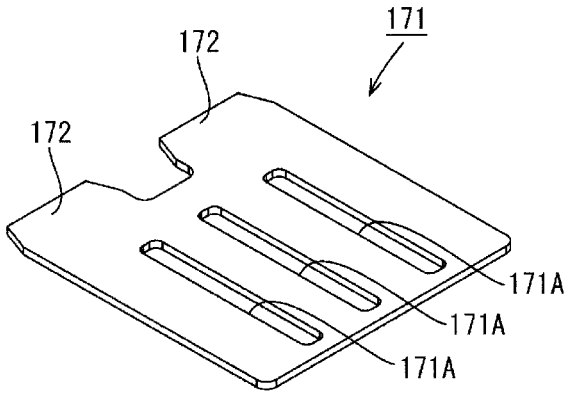
FIG. 76 is a perspective view showing the first wall portion.

The housing 161 is made of insulating synthetic resin and includes the body 31 and an extending portion 162 extending behind the body 31 while having a small vertical thickness. As shown in FIG. 74, left and right press-fit holes 163 are formed on the rear end surface of the extending portion 162.

(Shield Wall Portion 170)

Figure 66:
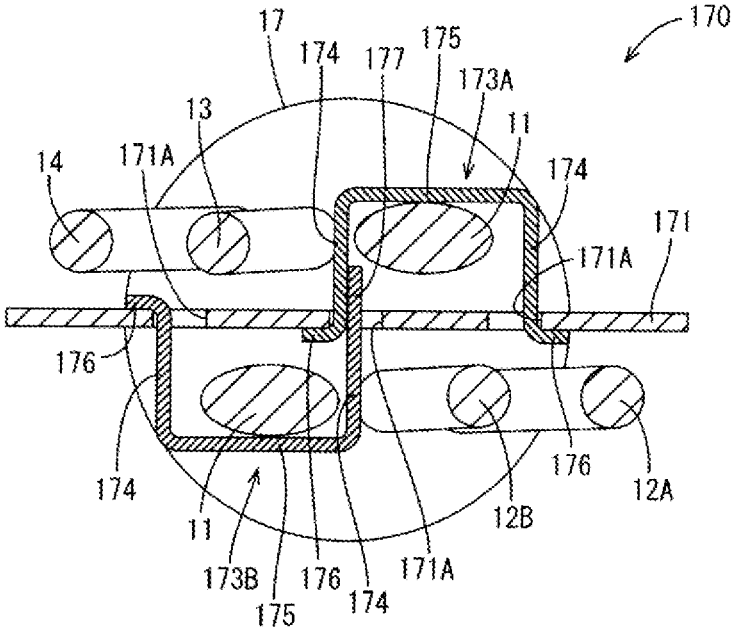
FIG. 66 is a section along B-B of FIG. 65.
Figure 67:
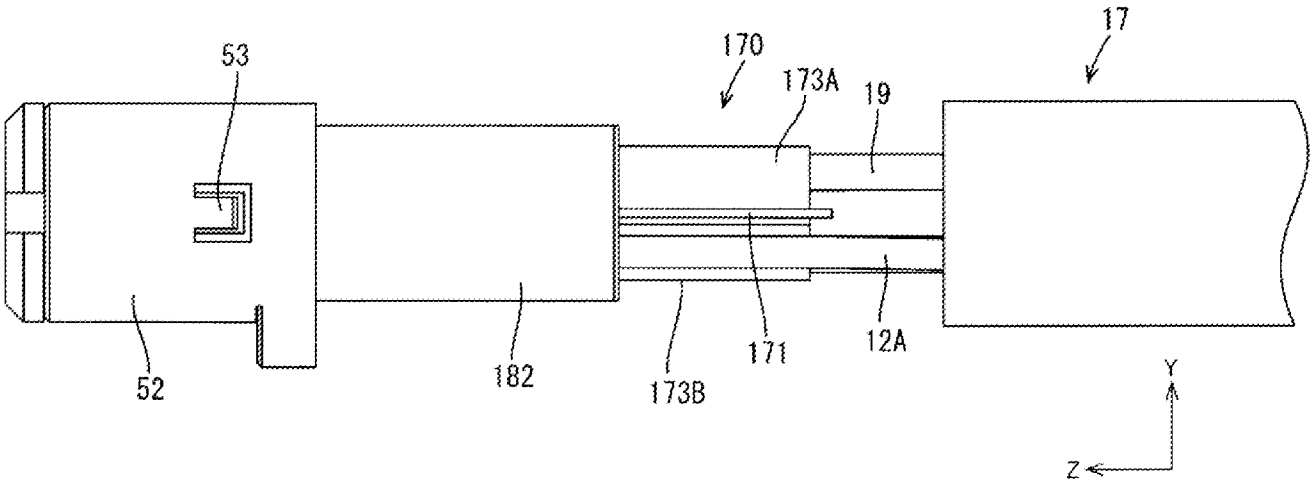
FIG. 67 is a side view showing the communication connector in the state where the second shield case is removed.
Figure 68:
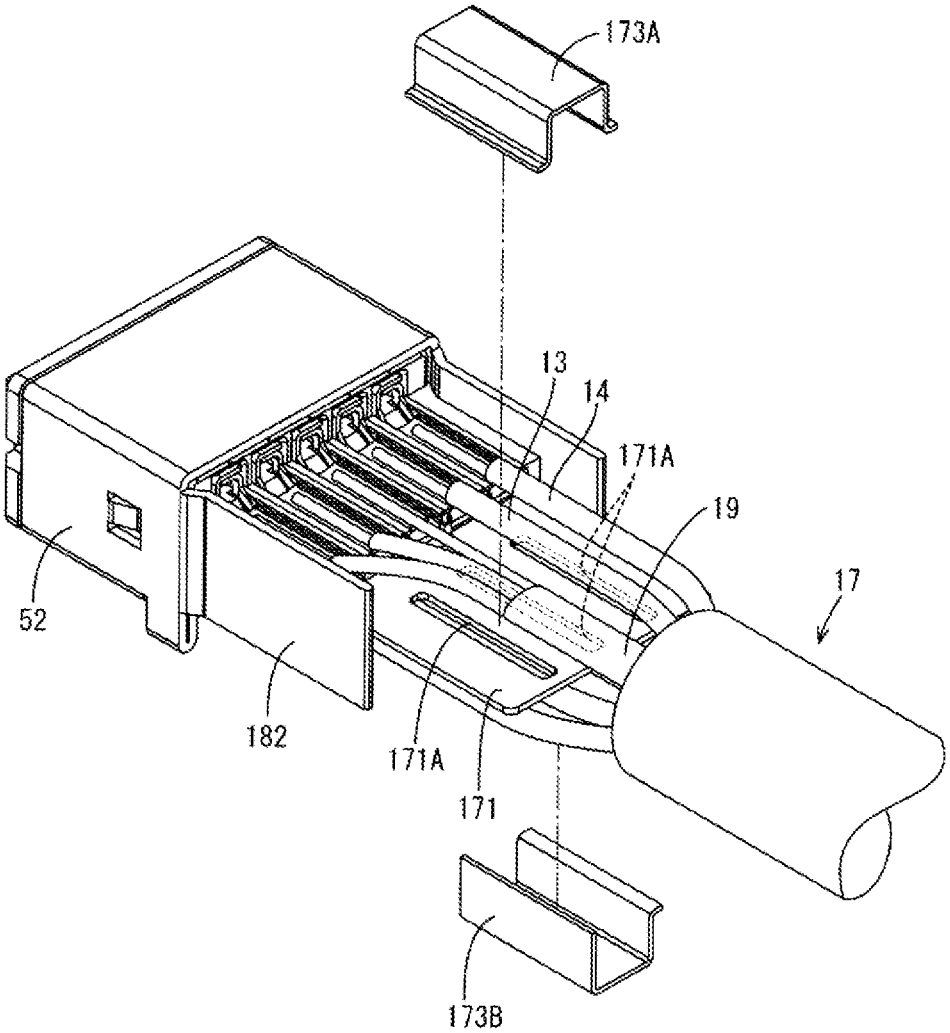
FIG. 68 is a perspective view showing a state where tubular portions are removed from a first wall portion.
Figure 69:
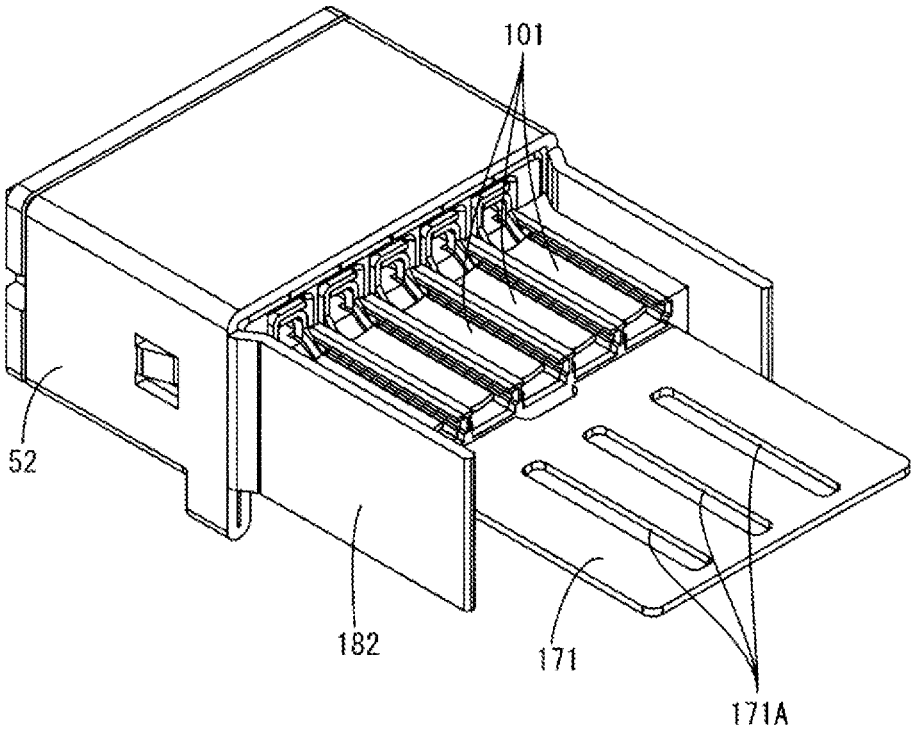
FIG. 69 is a perspective view showing the communication connector in a state where the second shield case and a shielded cable are removed.
Figure 70:
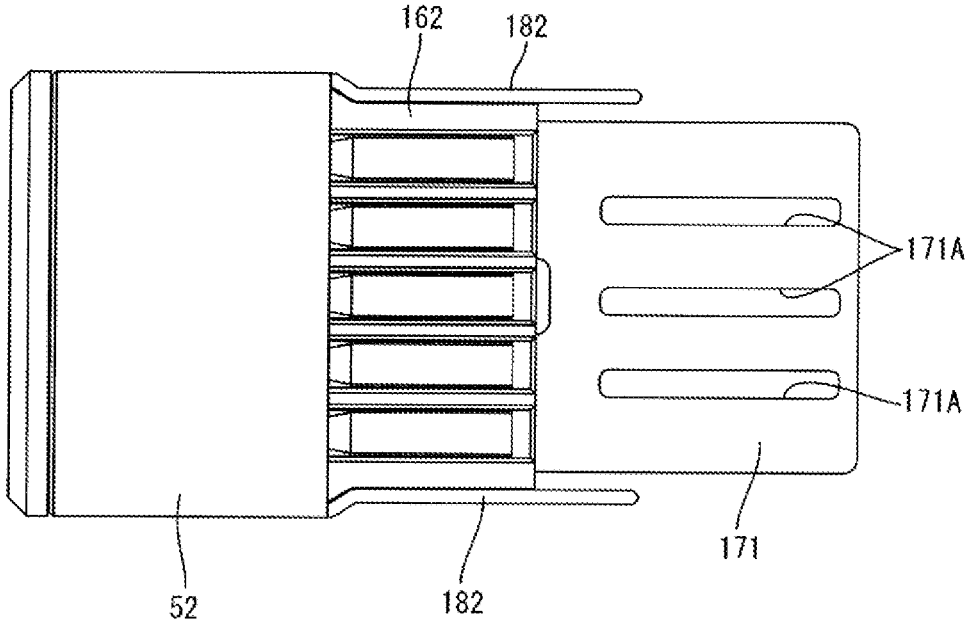
FIG. 70 is a plan view showing the communication connector in the state where the second shield case and the shielded cable are removed.
Figure 71:
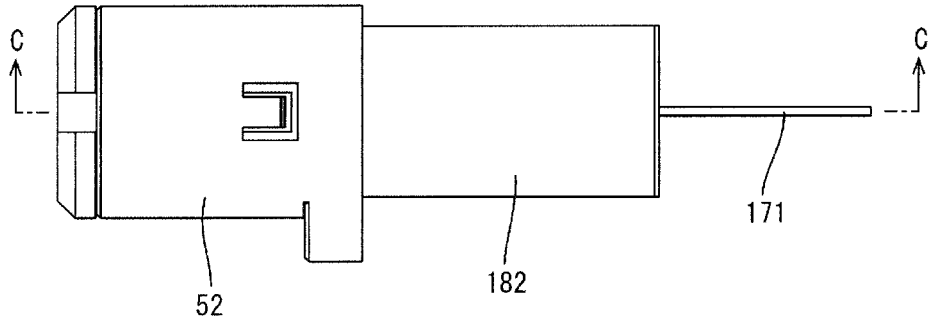
FIG. 71 is a side view showing the communication connector in the state where the second shield case and the shielded cable are removed.
Figure 72:
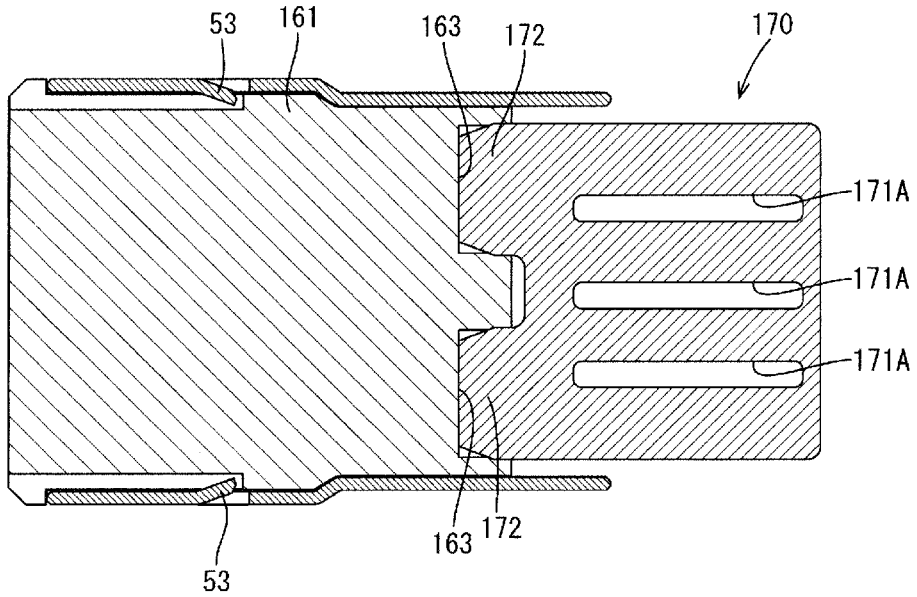
FIG. 72 is a section along C-C of FIG. 71.
Figure 73:
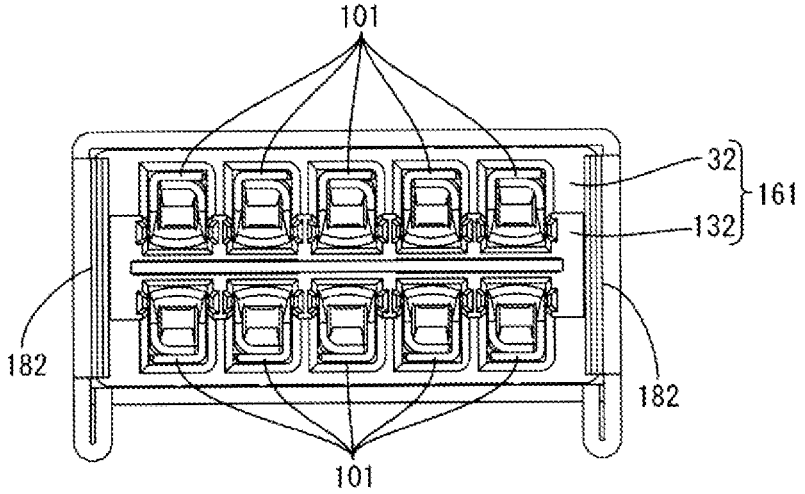
FIG. 73 is a back view showing the communication connector in the state where the second shield case and the shielded cable are removed.

The shield 170 is formed by applying punching and bending to a metal plate material, such as aluminum, aluminum alloy, copper or copper alloy, and includes, as shown in FIGS. 64 and 66, the plate-like first wall 171 extending in a lateral direction and the tubular portions 173A, 173B enclosing first wires 11A to 11C. Groove-like locking holes 171A extend in a front-rear direction and penetrate the first wall 171. As shown in FIG. 72, left and right press-fitting portions 172 to be press-fit into the press-fit holes 163 extend flush with each other in front of the first wall 171.

Figure 77:
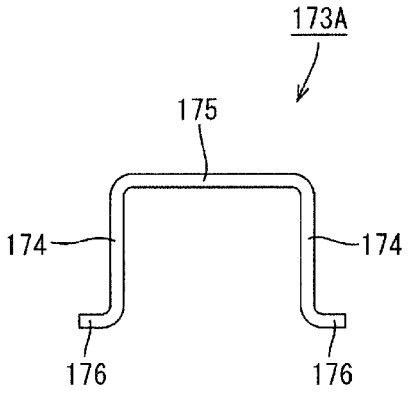
FIG. 77 is a front view showing one tubular portion.
Figure 78:
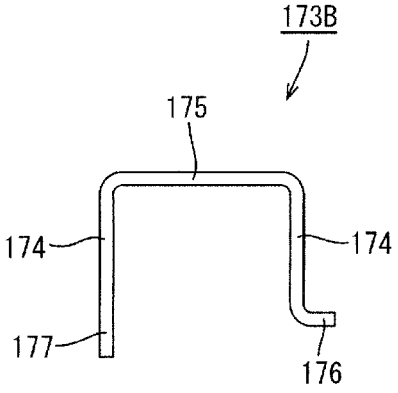
FIG. 78 is a front view showing the other tubular portion.

As shown in FIGS. 66, 77 and 78, the tubular portion 173A, 173B is formed separately from the first wall 171 and includes two second walls 174 standing from the first wall 171, a coupling wall 175 connecting the second walls 174 and a locking claw(s) 176 to be locked to the first wall 171. The locking claws 176 are formed on each of the left and right second walls 174 in the tubular portion 173A, whereas the locking claw 176 is formed on one second wall 174, but an inserting portion 177 to be inserted into the locking hole 171A (through hole) is formed on the other second wall 174 in the tubular portion 173B. The inserting portion 177 extends straight from the second wall 174. The inner surface of the second wall 174 of the tubular portion 173A formed at the position of the locking hole 171A into which the inserting portion 177 is inserted is held in surface contact with the inner surface of the inserting portion 177.

The second walls 174 are resiliently deformable relative to the coupling wall 175, and the locking claws 176 (and the inserting portion 177) are inserted into the locking holes 171A by resiliently deforming the second walls 174 inward. Then, the second walls 174 are restored so that the locking claws 176 are locked to the hole edges of the locking holes 171A and the position of the tubular portion 173A, 173B is fixed with respect to the first wall 171.

The first wires 11A to 11C collectively enclosed by a shield layer 19 are inserted at intervals into the tubular portion 173A, 173B. Note that a plurality of second wires 12A, 12B, a power supply wire 13 and a ground wire 14 are arranged at intervals on the first wall 171 outside the tubular portions 173A, 173B.

According to the seventh embodiment, the conductive coupling wall portion 175 is provided and couples the second walls 174 to cover the wires 11 between a plurality of adjacent second walls 174. Thus, the outer sides of the wires 11 between the second walls 174 can be shielded by the coupling wall 175.

The invention is not limited to the above described and illustrated embodiments. For example, the following embodiments also are included in the technical scope of the present invention.

Although the shield 40, 70, 95, 120 includes the first walls 42, 71, 96, 121 and the second walls 43, 73, 97, 122, only either the first walls 42, 71, 96, 121 or the second walls 43, 73, 97, 122 may be provided.

Although the first wires 11 in the different wire rows 16A, 16B are diagonally arranged, the first wires 11 may not be diagonally arranged.

The number of the wires 11 to 14 is not limited to the above number. Further, places where the wires 11 to 14 are partitioned by the shield walls 40, 70, 95, 120 can be set arbitrarily according to the number of the wires, the types of the wires and the like.

LIST OF REFERENCE SIGNS

10, 110, 130: communication connector
11A to 11C (11): first wire
12A, 12B (12): second wire
13: power supply wire
15: ground wire
16A, 16B: wire row
17: shielded cable
20, 81, 101: terminal
30, 61, 86, 91, 112, 131, 161: housing
32: cavity
36, 62, 88, 92, 113, 132, 162: extending portion
37, 87, 114: placing portion
38A, 38B, 63A to 63C, 93, 163: press-fit hole
40, 70, 95, 120, 140, 170: shield
41, 41: two partition plates
42, 71, 96, 121, 141, 171: first wall
43, 73, 97, 122, 144, 174: second wall
44, 72A to 72C, 98, 172: press-fitting portion
45, 74, 99, 146: case connecting portion
50, 118, 150, 180: shield case
116: support
145, 175: coupling wall

The invention claimed is:

1. A communication connector, comprising:

a housing with a body having opposite front and rear ends, cavities extending through the body from the rear end to the front end, the cavities being arranged in first and second rows, an extending portion extending rearward from the body at a position between the first and second rows of cavities;

terminals accommodated respectively in the cavities;

wires connected respectively to the terminals, the wires that are connected to the terminals in the cavities of the first row being disposed at least partly on a first surface of the extending portion, and the wires that are connected to the terminals in the second row being disposed at least partly on a second surface of the extending portion that is opposite the first surface, areas of the wires disposed on the extending portion being substantially parallel to one another; and first and second conductive shields arranged respectively on the first and second surfaces of the extending portion, each of the conductive shields having a wall facing the extending portion, tubular portions extending from the wall and communication grooves extending through the wall and communicating respectively with the tubular portions, the tubular portions being configured to substantially surround the respective wires and being disposed so that the wires on the first surface of the extending portion are offset diagonally from the wires on the second surface of the extending portion.

2. The communication connector of claim 1, wherein the shield is fixed to the housing.

3. The communication connector of claim 1, wherein the shield is made of conductive resin.

4. The communication connector of claim 1, further comprising a shield case with a surrounding portion for covering body of the housing, and coupling portions extending rearward from the surrounding portion and along opposite sides of the extending portion of the housing, wherein each of the conductive shields includes a case connecting portion to be connected electrically to the coupling portions of the shield case.

5. The communication connector of claim 4, wherein the connecting portion of each of the conductive shields projects laterally from the wall of the respective conductive shield and engages one of the coupling portions of the shield case.

6. The communication connector of claim 5, wherein each of the conductive shields has two connecting portions connected respectively to the coupling portions of the shield case.

7. The communication connector of claim 1, wherein the wires comprise at least one wire that has cross-sectional dimensions larger than at least one other one of the wires, the tubular portions of the conductive shields being dimensioned respectively to engage the wires.

8. The communication connector of claim 7, wherein at least one of the wires is a power wire and a plurality of the wires are communication wires.

9. The communication connector of claim 1, wherein the communication connector has opposite first and second lateral sides, the wires comprise a first cross-sectionally large wire disposed on the first surface of the extending portion at the first side of the communication connector and a second cross-sectionally large wire disposed on the second surface of the extending portion at the second side of the communication connector so that the first and second cross-sectionally large wires are disposed at opposite lateral sides of the communication connector.

10. The communication connector of claim 1, wherein each of the communication grooves has an opening width narrower than a diameter of the tubular portion.

* * * * *